US012344807B2

(12) United States Patent
Pham et al.

(10) Patent No.: US 12,344,807 B2
(45) Date of Patent: Jul. 1, 2025

(54) HYDROCARBON GAS PROCESSING

(71) Applicant: UOP LLC, Des Plaines, IL (US)

(72) Inventors: Thai Pham, Midland, TX (US); J Ascencion Anguiano, Midland, TX (US); Hank M. Hudson, Midland, TX (US); Kyle T. Cuellar, Fort Bend, TX (US); Adam Brostow, Schaumburg, IL (US); Stephen N Peterson, Midland, TX (US); Michael C. Pierce, Midland, TX (US)

(73) Assignee: UOP LLC, Des Plaines, IL (US)

( * ) Notice: Subject to any disclaimer, the term of this patent is extended or adjusted under 35 U.S.C. 154(b) by 371 days.

(21) Appl. No.: 17/949,085

(22) Filed: Sep. 20, 2022

(65) Prior Publication Data

US 2023/0021328 A1 Jan. 26, 2023

Related U.S. Application Data

(63) Continuation-in-part of application No. 17/084,825, filed on Oct. 30, 2020, now Pat. No. 11,448,461.

(51) Int. Cl.

| | |
|---|---|
| ***F25J 3/00*** | (2006.01) |
| ***C10L 3/10*** | (2006.01) |
| ***F25J 3/02*** | (2006.01) |

(52) U.S. Cl.

CPC ..... *C10L 3/105* (2013.01); *F25J 3/0209* (2013.01); *F25J 3/0233* (2013.01); *F25J 3/0238* (2013.01);

(Continued)

(58) Field of Classification Search

CPC ..... F25J 3/0257; F25J 3/0233; F25J 3/0238; F25J 3/0209; F25J 3/0242; F25J 2200/94;

(Continued)

(56) References Cited

U.S. PATENT DOCUMENTS 4,171,964 A * 10/1979 Campbell ..... F25J 3/0219 62/621
4,451,275 A * 5/1984 Vines ..... F25J 3/0257 62/622

(Continued)

*Primary Examiner* — Brian M King
(74) *Attorney, Agent, or Firm* — Paschall & Associates, LLC; Mark Goldberg

(57) ABSTRACT

A process and an apparatus are disclosed for separation of a hydrocarbon gas stream containing methane and heavier hydrocarbons and significant quantities of nitrogen and carbon dioxide. The gas stream is cooled and expanded, then fractionated in a first distillation column into a first overhead vapor and a hydrocarbon liquid stream containing the majority of the carbon dioxide. The hydrocarbon liquid stream is fractionated into a hydrocarbon vapor stream and a less volatile fraction comprised of heavier hydrocarbons.

The first overhead vapor is cooled, expanded, and separated into vapor and liquid streams. Both streams are cooled and expanded before feeding a second distillation column that produces a second overhead vapor that is predominantly nitrogen and a bottom liquid that is predominantly methane. The bottom liquid is vaporized and combined with the hydrocarbon vapor stream to form a volatile residue gas fraction containing the majority of the methane.

20 Claims, 16 Drawing Sheets

(52) U.S. Cl.
CPC ..... *F25J 3/0242* (2013.01); *F25J 3/0257* (2013.01); *C10L 2290/06* (2013.01); *C10L 2290/543* (2013.01); *F25J 2200/34* (2013.01); *F25J 2200/94* (2013.01); *F25J 2210/42* (2013.01); *F25J 2220/62* (2013.01); *F25J 2250/50* (2013.01)

(58) Field of Classification Search
CPC .. F25J 2200/34; F25J 2205/50; F25J 2210/42; F25J 2220/62
See application file for complete search history.

(56) References Cited

U.S. PATENT DOCUMENTS

| | | | | |
|---|---|---|---|---|
| 5,791,160 | A * | 8/1998 | Mandler | F25J 1/0052 62/611 |
| 2015/0073194 | A1* | 3/2015 | Hudson | F25J 3/0233 62/620 |
| 2016/0054054 | A1* | 2/2016 | Johnson | F25J 3/0233 62/622 |
| 2018/0363977 | A1* | 12/2018 | Demolliens | F25J 3/0238 |

* cited by examiner (BASE CASE)

(BASE CASE)

HYDROCARBON GAS PROCESSING

This application is a continuation of Ser. No. 17/084,825 filed Oct. 30, 2020 which claimed the benefit under Title 35, United States Code, Section 119(e) of prior U.S. Provisional Application No. 62/928,187 which was filed on Oct. 30, 2019 and No. 63/025,006 which was filed on May 14, 2020. This invention relates to a process and apparatus for the separation of a gas containing hydrocarbons and significant quantities of nitrogen.

BACKGROUND OF THE INVENTION

Methane, ethylene, ethane, propylene, propane, and/or heavier hydrocarbons are found in a variety of gases, such as natural gas, refinery gas, and synthetic gas streams obtained from other hydrocarbon materials such as coal, crude oil, naphtha, oil shale, tar sands, and lignite. These hydrocarbon-bearing gases often contain components more volatile than methane such as nitrogen in addition to methane, ethane and hydrocarbons of higher molecular weight such as propane, butane, and pentane. In some cases, the concentration of nitrogen in the gas may be so high that it cannot be sold to commercial gas transportation and distribution networks.

The present invention is generally concerned with removing nitrogen from such gas streams so that the inert content is then acceptably low and the gas will be acceptable for transport by gas distribution companies. A typical analysis of a gas stream to be processed in accordance with this invention would be, in approximate mole percent, 76.1% methane, 5.6% ethane and other $C_2$ components, 2.3% propane and other $C_3$ components, 0.5% iso-butane, 0.9% normal butane, 0.8% pentanes plus, 12.7% nitrogen, and 1.0% carbon dioxide, with the balance made up of minor amounts of other inert components. Sulfur-containing gases are also sometimes present.

Most commercial gas transportation and distribution companies have strict specifications regarding the quality of the gas that is acceptable for transport. These specifications typically address the heat content of the gas (i.e., Wobbe index), the water content of the gas, the hydrocarbon dewpoint of the gas, and the concentration of inert components like nitrogen and carbon dioxide in the gas. Compliance with these specifications is mandatory for selling gas to these companies, as it ensures consistent quality of the gas distributed to their customers.

Some gas streams contain high concentrations of inert gases like nitrogen and carbon dioxide due to the nature of the gas field or other source of the gas. Unless the inert content of the gas can be reduced, the gas field or source cannot be produced and has no value. In such instances, removal of the nitrogen can be a viable option to make the gas stream acceptable for sale.

There are a number of methods for removing nitrogen from hydrocarbon streams, such as semipermeable membranes and solid adsorbents, but the preferred method is generally cryogenic distillation because it minimizes the loss of the valuable hydrocarbons with the nitrogen being removed. U.S. Pat. Nos. 4,451,275; 9,671,162; and 10,359,230; U.S. Patent Application Publication No. US 2019/0301795; and U.K. Patent Application Nos. GB 2571945 A and GB 2571946 A are examples of such methods. However, cryogenic distillation requires that essentially all the carbon dioxide and water be removed from the gas stream before it can be processed in order to prevent carbon dioxide freezing and water freezing inside the process. While dehydration of the gas stream is relatively simple and inexpensive (typically using solid desiccant to remove the water), removal of carbon dioxide generally requires an acid gas removal unit (AGRU) using aqueous amine solvents or other specialty solvents. AGRUs are expensive to build and operate and add considerable capital cost and operating cost to the gas processing facility.

The present invention does not require removal of carbon dioxide before removing the nitrogen. This eliminates the AGRU used in the prior art, reducing capital cost and operating cost compared to the prior art. The present invention also reduces the power required to provide the refrigeration for the cryogenic distillation, further reducing capital cost and operating cost compared to the prior art.

In accordance with the present invention, it has been found that gases containing 1 mole % carbon dioxide or more can be processed to reduce the nitrogen concentration below 3 mole %. The present invention is particularly advantageous when processing feed gases that contain more than 10 mole % of nitrogen.

For a better understanding of the present invention, reference is made to the following examples and drawings. Referring to the drawings:

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE BASE CASE

Figure 1A:
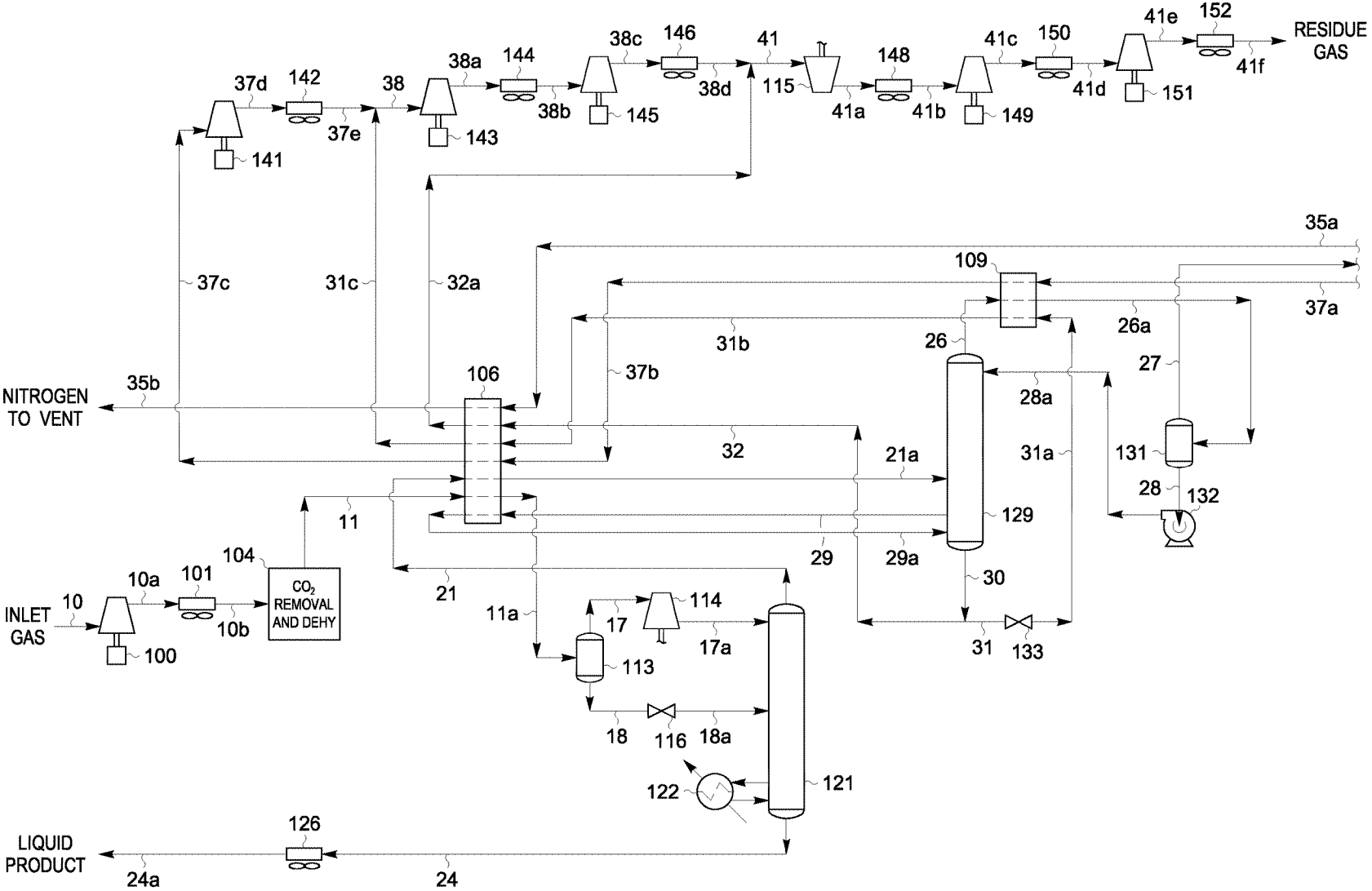
FIGS. 1*a*/1*b* are a flow diagram of a base case gas processing plant.
Figure 1B:
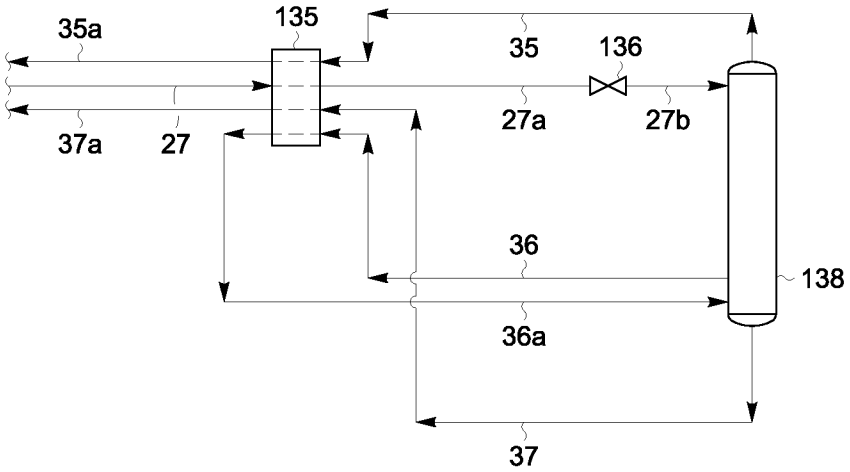

FIGS. 1*a*/1*b* are a process flow diagram showing the design of a processing plant to remove nitrogen from a gas stream. In this simulation of the process, inlet gas enters the plant at 150° F. [66° C.] and 180 psia [1,239 kPa(a)] as stream 10. If the inlet gas contains a concentration of sulfur compounds which would prevent the product streams from meeting specifications, the sulfur compounds are removed by appropriate pretreatment of the feed gas (not illustrated). The feed stream 10 enters compressor 100 and is boosted to higher pressure. After cooling to 135° F. [57° C.] in cooler 101, stream 10*b* at 330 psia [2,273 kPa(a)] is treated and dehydrated in unit 104 to remove carbon dioxide and water. An AGRU is used to remove the carbon dioxide, followed by dehydration to prevent hydrate (ice) formation under cryogenic conditions (typically using solid desiccant).

Before proceeding to the nitrogen removal columns (high pressure nitrogen column 129 and low-pressure nitrogen column 138), some of the heavier hydrocarbons in the feed gas must be removed so that the resulting residue gas does not have excessive heat content and/or hydrocarbon dew-point after the nitrogen is removed. This is accomplished in stabilizer column 121. The treated and dehydrated stream 11 at 135° F. [57° C.] and 315 psia [2,170 kPa(a)] is cooled in heat exchanger 106 by heat exchange with cool nitrogen (stream 35*a*), column bottom liquid stream 32, flash expanded hydrocarbon streams 31*b* and 37*b*, and reboiler liquids (stream 29) from high pressure nitrogen column 129. Note that in all cases exchanger 106 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 11*a* enters separator 113 at 0° F. [−18° C.] and 311 psia [2,142 kPa(a)] where the vapor (stream 17) is separated from the condensed liquid (stream 18). The vapor (stream 17) from separator 113 enters work expansion machine 114 in which mechanical energy is extracted from this portion of the high-pressure feed. The machine 114 expands the vapor substantially isentropically to the operating pressure (approximately 225 psia [1,549 kPa(a)]) of stabilizer column 121, with the work expansion cooling the expanded stream 17*a* to a temperature of approximately −24° F. [−31° C.]. The typical commercially available expanders are capable of recovering on the order of 80-85% of the work theoretically available in an ideal isentropic expansion. The work recovered is often used to drive a centrifugal compressor (such as item 115) that can be used to compress the residue gas (stream 41), for example. The expanded stream 17*a* is thereafter supplied to fractionation tower 121 at the top column feed position. The separator liquid (stream 18) is expanded to the operating pressure of stabilizer column 121 by expansion valve 116, cooling stream 18*a* to −2° F. [−19° C.] before it is supplied to the column at a mid-column feed position.

The stabilizer in tower 121 is a conventional distillation column containing a plurality of vertically spaced trays, one or more packed beds, or some combination of trays and packing. As is often the case in gas processing plants, the fractionation tower may consist of two sections. The upper section is a separator wherein the top feed is divided into its respective vapor and liquid portions, and wherein the vapor rising from the lower stripping (stabilizing) section is combined with the vapor portion of the top feed to form the stabilizer overhead vapor (stream 21) which exits the top of the tower at −20° F. [−29° C.]. The lower stripping section contains the trays and/or packing and provides the necessary contact between the liquids falling downward and the vapors rising upward. The stabilizing section also includes one or more reboilers (such as the reboiler 122) which heat and vaporize a portion of the liquids flowing down the column to provide the stripping vapors which flow up the column to strip the liquid product, stream 24 of butane and lighter components.

Liquid product stream 24 exits the bottom of the tower at 348° F. [176° C.], based on a typical specification of a Reid vapor pressure of 12.5 psia [86 kPa(a)] for the stabilized condensate bottom product. It is cooled to 135° F. [57° C.] in cooler 126 before flowing to storage.

The stabilizer overhead vapor (stream 21) enters heat exchanger 106 where it is cooled to −192° F. [−124° C.] (stream 21*a*) as described previously. It then enters high pressure nitrogen column 129 (operating at approximately 215 psia [1,480 kPa(a)]) at a mid-column feed position. Tower 129 is a conventional distillation column containing a plurality of vertically spaced trays, one or more packed beds, or some combination of trays and packing. The heat input for the reboiler in its lower stripping section is provided by supplying distillation liquid stream 29 to heat exchanger 106, heating it from −189° F. [−123° C.] to −182° F. [−119° C.] by providing cooling to streams 11 and 21 as described previously, whereupon stream 29*a* returns to column 129.

Overhead vapor stream 26 leaves column 129 at −202° F. [−130° C.] and enters heat exchanger 109 where it is cooled to −220° F. [−140° C.] by heat exchange with flash expanded hydrocarbon streams 37*a* and 31*a*. Partially condensed stream 26*a* then enters reflux drum 131 where the vapor (stream 27) is separated from the condensed liquid (stream 28). Reflux pump 132 pumps liquid stream 28 to higher pressure so that it can be returned to column 129 (stream 28*a*) at the top column feed position. This cold liquid reflux absorbs and condenses the $C_2$ components, C3 components, and heavier components (including n-pentane, heavier n-paraffins, and aromatic hydrocarbons like benzene and toluene that could freeze out of solution in low pressure nitrogen column 138) from the vapor rising in the upper region of column 129 so that only methane and nitrogen remain in overhead vapor stream 26.

The reboiling in the bottom of high-pressure nitrogen column 129 is controlled to limit the amount of nitrogen leaving the column in bottom liquid stream 30, as the majority of the hydrocarbon residue gas from the process (stream 41) is produced by vaporizing this liquid. A portion (stream 31) of the bottom liquid product (stream 30) at −182° F. [−119° C.] is expanded to approximately 65 psia [446 kPa(a)] by expansion valve 133, cooling stream 31*a* to −221° F. [−141° C.]. Expanded stream 31*a* enters heat exchanger 109 and is heated to −218° F. [−139° C.] as it provides cooling to stream 26 as described previously. Partially warmed stream 31*b* and the remaining portion (stream 32) of the bottom liquid product (stream 30) then flow to heat exchanger 106 and are heated to 131° F. [55° C.] as they provide cooling to streams 11 and 21 as described previously.

The vapor (stream 27) from reflux drum 131 is condensed as it is cooled to −288° F. [−178° C.] in heat exchanger 135 by heat exchange with cold nitrogen (stream 35), column bottom liquid stream 37, and reboiler liquids (stream 36) from low pressure nitrogen column 138. Condensed stream 27*a* is then expanded to the operating pressure (approximately 28 psia [191 kPa(a)]) of low-pressure nitrogen column 138 by expansion valve 136, further cooling stream 27*b* to −304° F. [−186° C.] before it is supplied to low pressure nitrogen column 138 as cold reflux at the top column feed position. Tower 138 is a conventional distillation column containing a plurality of vertically spaced trays, one or more packed beds, or some combination of trays and packing. The heat input for the reboiler in its lower stripping section is provided by supplying distillation liquid stream 36 to heat exchanger 135, heating it from −283° F. [−175° C.] to −250° F. [−157° C.] by providing cooling to stream 27 as described previously, whereupon stream 36*a* returns to column 138.

The reboiling in the bottom of low-pressure nitrogen column 138 is controlled to limit the amount of nitrogen leaving the column in bottom liquid stream 37, as part of the hydrocarbon residue gas from the process (stream 41) is produced by vaporizing this liquid. Bottom liquid product stream 37 at −250° F. [−157° C.] flows to heat exchanger 135 and is heated to −244° F. [−154° C.] as it provides cooling to stream 27 as described previously. Heated partially vaporized stream 37*a* flows to heat exchanger 109 where it is heated to −211° F. [−135° C.] (stream 37*b*) and then to heat exchanger 106 where it is heated to 131° F. [55° C.] (stream 37*c*) as it provides cooling to streams 26, 11, and 21 as described previously.

The column overhead vapor (cold nitrogen vent stream 35) leaves low pressure nitrogen column 138 at −304° F. [−187° C.], containing only 2.0 mole % methane due to the rectification provided by cold reflux stream 27*b*. It flows to heat exchanger 135 where it is heated to −241° F. [−152° C.] (stream 35*a*) and to heat exchanger 106 where it is heated to 131° F. [55° C.] (stream 35*b*) as it provides cooling to streams 27, 11, and 21 as described previously.

The warmed vaporized hydrocarbon streams (streams 37*c*, 31*c*, and 32*a*) from nitrogen columns 138 and 129 are compressed in six stages (compressors 141, 143, 145, 115, 149, and 151), with cooling after each stage (coolers 142, 144, 146, 148, 150, and 152) to 135° F. [57° C.]. Stream 37*c* is compressed by the first stage before combining with *stream* 31*c* to form stream 38. Stream 38 is compressed by the second and third stages before combining with stream 32*a* to form stream 41. Stream 41 is compressed by the final three stages before flowing to the gas transmission pipeline as residue gas stream 41*f* at 1365 psia [9,411 kPa(a)].

A summary of stream flow rates and energy consumption for the process illustrated in FIGS. 1*a*/1*b* is set forth in the following Table I:

TABLE I (FIGS. 1a/1b)
Stream Flow Summary - Lb. Moles/Hr [kg moles/Hr]

| Stream | Nitrogen | $CO_2$ | Methane | Ethane | Propane. | Butane+ | Total |
|---|---|---|---|---|---|---|---|
| 10 | 2,800 | 222 | 16,710 | 1,232 | 512 | 485 | 21,961 |
| 11 | 2,800 | 0 | 16,710 | 1,232 | 512 | 485 | 21,739 |
| 17 | 2,799 | 0 | 16,674 | 1,212 | 476 | 279 | 21,439 |
| 18 | 1 | 0 | 36 | 20 | 36 | 206 | 300 |
| 21 | 2,800 | 0 | 16,710 | 1,232 | 512 | 323 | 21,577 |
| 26 | 2,650 | 0 | 3,074 | 0 | 0 | 0 | 5,723 |
| 27 | 2,057 | 0 | 937 | 0 | 0 | 0 | 2,994 |
| 28 | 593 | 0 | 2,137 | 0 | 0 | 0 | 2,729 |
| 30 | 743 | 0 | 15,773 | 1,232 | 512 | 323 | 18,583 |
| 31 | 331 | 0 | 7,019 | 548 | 228 | 144 | 8,269 |
| 32 | 412 | 0 | 8,754 | 684 | 284 | 179 | 10,314 |
| 37 | 19 | 0 | 896 | 0 | 0 | 0 | 914 |
| 35 | 2,038 | 0 | 41 | 0 | 0 | 0 | 2,080 |
| 41 | 762 | 0 | 16,669 | 1,232 | 512 | 323 | 19,497 |
| 24 | 0 | 0 | 0 | 0 | 0 | 162 | 162 |

Performance*

| | | |
|---|---|---|
| Nitrogen in Residue Gas | 3.9 mole % | |
| Carbon Dioxide in Residue Gas | 0.0 mole % | |
| HC Dewpoint of Residue Gas | 3° F. | [−16° C.] |
| Methane in Nitrogen Vent | 2.0 mole % | |
| Reid Vap. Pres. of Condensate | 11.7 PSIA | [81 kPa(a)] |

Power

| | | |
|---|---|---|
| Inlet Gas Compression | 8,852 HP | [14,552 kW] |
| Residue Gas Compression | 31,084 HP | [51,102 kW] |
| Total Compression | 39,936 HP | [65,654 kW] |

*(Based on un-rounded flow rates)

DESCRIPTION OF THE INVENTION

Example 1

Figure 2A:
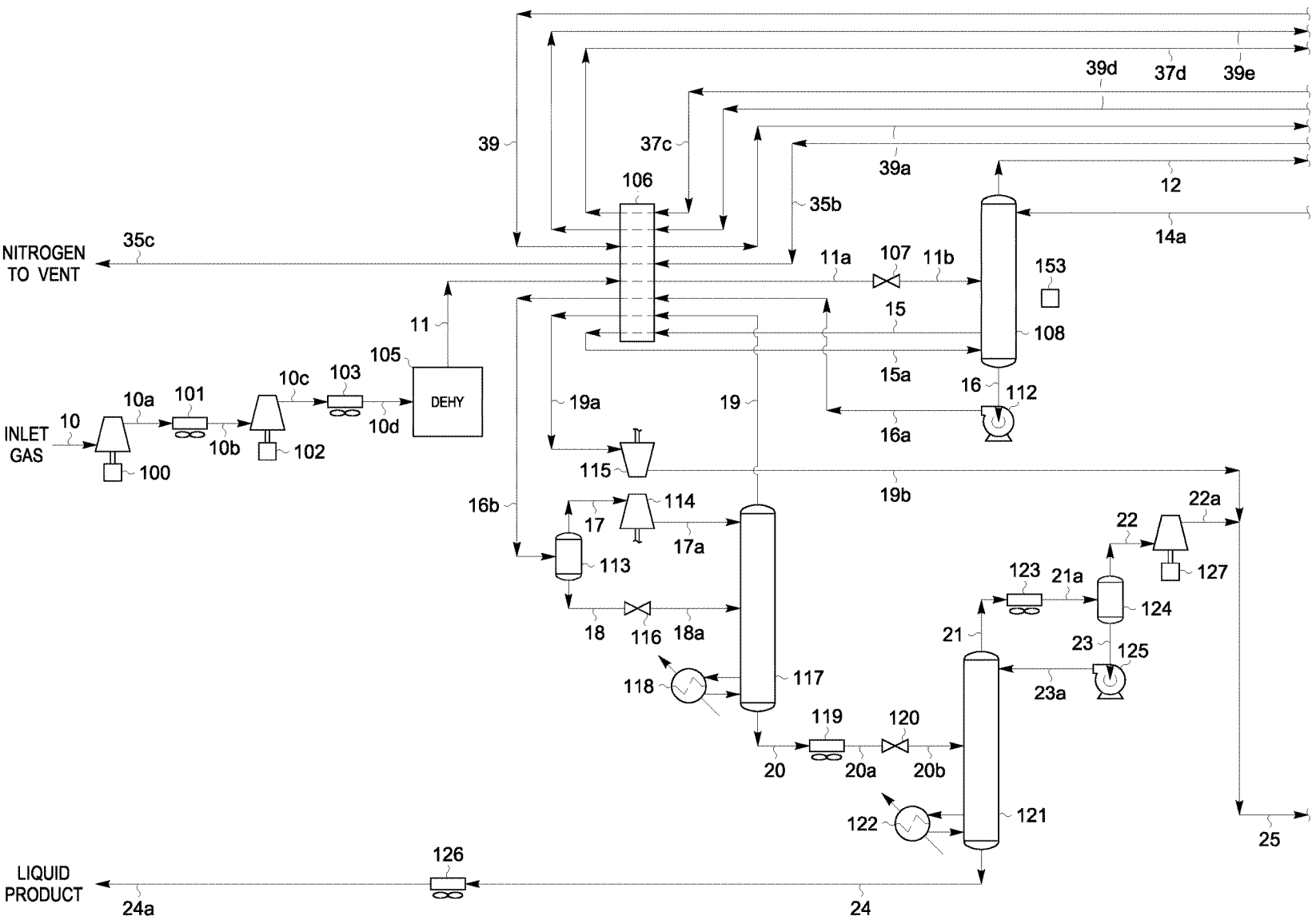
FIGS. 2*a*/2*b* are a flow diagram of a gas processing plant in accordance with the present invention.
Figure 2B:
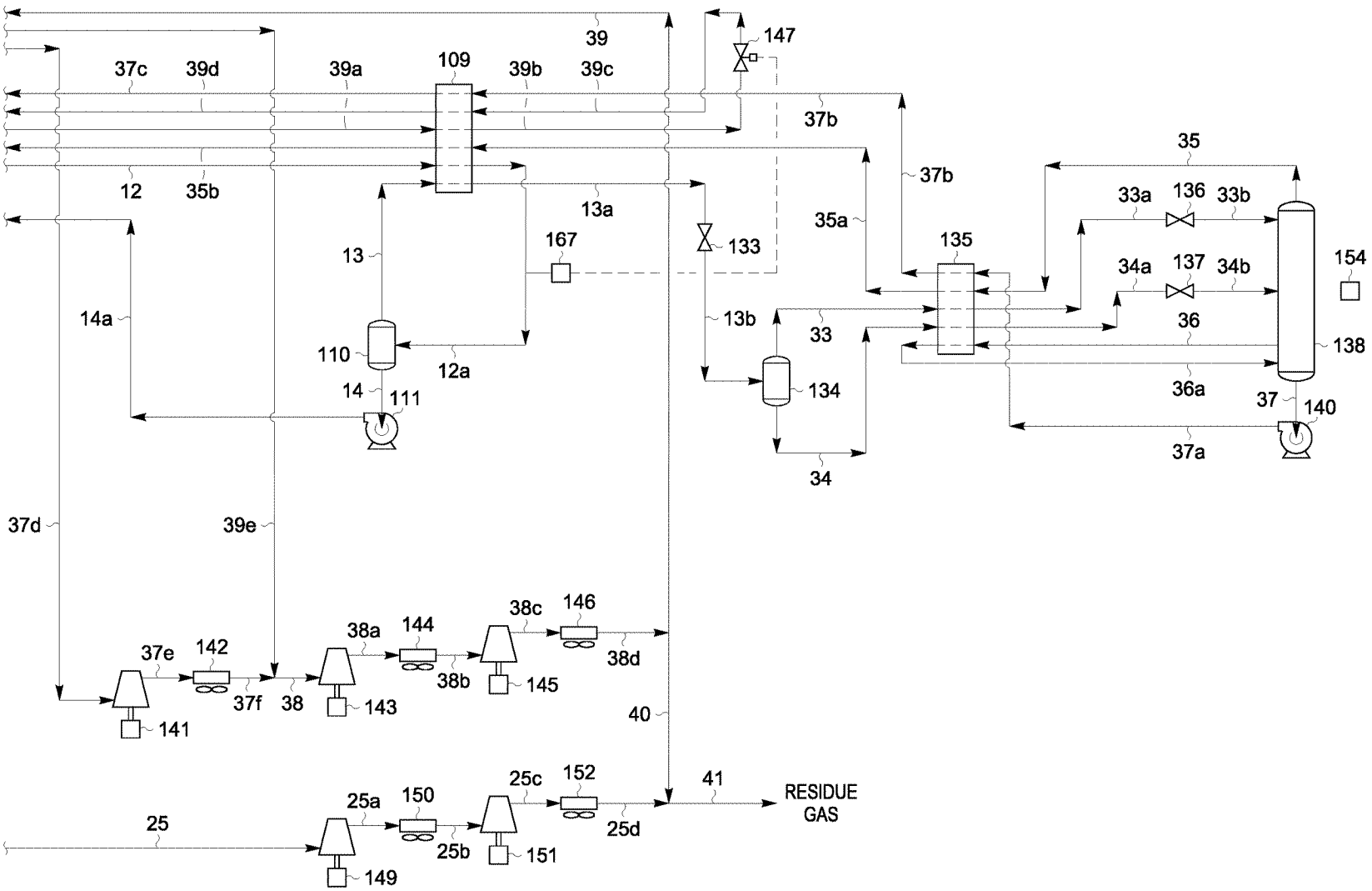

FIGS. 2*a*/2*b* illustrate a flow diagram of a process in accordance with the present invention. The feed gas composition and conditions considered in the process presented in FIGS. 2*a*/2*b* are the same as those in FIGS. 1*a*/1*b*. Accordingly, the FIGS. 2*a*/2*b* process can be compared with that of the FIGS. 1*a*/1*b* process to illustrate the advantages of the present invention. The feed stream 10 is compressed in two stages (compressors 100 and 102), with cooling after each stage (coolers 101 and 103) to 135° F. [57° C.]. Compressed and cooled stream 10*d* at 505 psia [3,480 kPa(a)] is dehydrated in unit 105 to remove water, but none of the carbon dioxide in the feed gas is removed.

The dehydrated stream 11 at 135° F. [57° C.] and 495 psia [3,411 kPa(a)] is cooled in heat exchanger 106 by heat exchange with cool nitrogen (stream 35*b*), cool vaporized hydrocarbon stream 37*c*, cool open loop refrigerant stream 39*d*, pumped column bottom liquid stream 16*a*, debutanizer overhead stream 19, and reboiler liquids (stream 15) from hydrocarbon recovery column 108. Cooled and partially condensed stream 11*a* at −142° F. [−97° C.] and 491 psia [3,383 kPa(a)] is then expanded to the operating pressure (approximately 435 psia [2,997 kPa(a)]) of hydrocarbon recovery column 108 by expansion valve 107, cooling stream 11*b* to −147° F. [−100° C.] before it is supplied to fractionation tower 108 at a mid-column feed position. Tower 108 is a conventional distillation column containing a plurality of vertically spaced trays, one or more packed beds, or some combination of trays and packing. The heat input for the reboiler in its lower stripping section is provided by supplying distillation liquid stream 15 to heat exchanger 106, heating it from −142° F. [−97° C.] to −136° F. [−93° C.] by providing cooling to stream 11 as described previously, whereupon stream 15*a* returns to column 108.

Overhead vapor stream 12, comprising nitrogen and no more than 0.001 mole % carbon dioxide leaves hydrocarbon recovery column 108 at −160° F. [−107° C.]. The overhead vapor stream 12 should be sufficiently cold to condense essentially all of the carbon dioxide and hydrocarbon, so as to prevent the entry of carbon dioxide into the overhead vapor stream 12. The overhead vapor stream 12 enters heat exchanger 109 where it is cooled to −170° F. [−112° C.] by heat exchange with cold nitrogen stream 35*a*, partially warmed column bottom liquid stream 37*b*, and cold open loop refrigerant stream 39*c*. Partially condensed stream 12*a* then enters reflux drum 110 where the vapor (stream 13) is separated from the condensed liquid (stream 14). A control device 167 measures a temperature of the partially condensed stream 12*a* and compares the measured temperature to a setpoint. Reflux pump 111 pumps liquid stream 14 to higher pressure so that stream 14*a* can be returned to column 108 at the top column feed position. This cold liquid reflux absorbs and condenses the $C_2$ components, $C_3$ components, and heavier components (including n-pentane, heavier n-paraffins, and aromatic hydrocarbons like benzene and toluene that could freeze out of solution in nitrogen column 138) from the vapor rising in the upper region of column 108. It also absorbs essentially all of the carbon dioxide, so that only methane and nitrogen remain in overhead vapor stream 12.

The reboiling in the bottom of hydrocarbon recovery column 108 is regulated by control means 153 to limit the amount of nitrogen leaving the column in bottom liquid stream 16, as the majority of the hydrocarbon residue gas from the process (stream 41) is produced from this liquid. Since the majority of the methane present in feed gas stream 10 leaves this column with stream 16, it never has to be processed in nitrogen column 138, reducing the refrigeration required for nitrogen column 138 and thereby reducing the power requirements of the process. Pump 112 pumps bottom liquid product stream 16 at −136° F. [−93° C.] to higher pressure before stream 16*a* flows to heat exchanger 106 and is heated as it provides cooling to stream 11 as described previously. Partially vaporized stream 16*b* then enters separator 113 at 21° F. [−6° C.] and 469 psia [3,232 kPa(a)] where the vapor (stream 17) is separated from the condensed liquid (stream 18). The vapor (stream 17) from separator 113 enters work expansion machine 114 in which mechanical energy is extracted from this portion of the high-pressure feed. The machine 114 expands the vapor substantially isentropically to the operating pressure (approximately 415 psia [2,859 kPa(a)]) of debutanizer column 117, with the work expansion cooling the expanded stream 17*a* to a temperature of approximately 10° F. [−12° C.]. The partially condensed expanded stream 17*a* is thereafter supplied as feed to fractionation tower 117 at the top column feed position. The separator liquid (stream 18) is expanded to the operating pressure of debutanizer column 117 by expansion valve 116, cooling stream 18*a* to 19° F. [−7° C.] before it is supplied to the column at a mid-column feed position. The debutanizer in tower 117 is a conventional distillation column containing a plurality of vertically spaced trays, one or more packed beds, or some combination of trays and packing. The upper section is a separator wherein the top feed is divided into its respective vapor and liquid portions, and wherein the vapor rising from the lower stripping (debutanizing) section is combined with the vapor portion of the top feed to form the debutanizer overhead vapor (stream 19) which exits the top of the tower at 10° F. [−12° C.]. The lower stripping section contains the trays and/or packing and provides the necessary contact between the liquids falling downward and the vapors rising upward. The debutanizing section also includes one or more reboilers (such as the reboiler 118) which heat and vaporize a portion of the liquids flowing down the column to provide the stripping vapors which flow up the column to strip the liquid product, stream 20, of most of the butane and lighter components. Overhead vapor stream 19 flows to heat exchanger 106 and is heated to 133° F. [56° C.] as it provides cooling to stream 11 as described previously. Stream 19*a* is then compressed to 431 psia [2,971 kPa(a)] by compressor 115.

Liquid product stream 20 exits the bottom of the tower at 297° F. [147° C.] and is cooled to 135° F. [57° C.] in cooler 119. Cooled liquid stream 20*a* is then expanded to the operating pressure (approximately 140 psia [963 kPa(a)]) of stabilizer column 121 by expansion valve 120 before stream 20*b* is supplied to the column at a mid-column feed position. The stabilizer in tower 121 is a conventional distillation column containing a plurality of vertically spaced trays, one or more packed beds, or some combination of trays and packing. The upper absorbing (rectifying) section allows the reflux (stream 23*a*) to absorb and condense the pentane and heavier components from the vapor rising from the lower stripping (stabilizing) section. The lower stripping section also contains trays and/or packing and provides the necessary contact between the liquids falling downward and the vapors rising upward. The stabilizing section also includes one or more reboilers (such as the reboiler 122) which heat and vaporize a portion of the liquids flowing down the column to provide the stripping vapors which flow up the column to strip the liquid product, stream 24 of butane and lighter components.

Liquid product stream 24 exits the bottom of the tower at 308° F. [153° C.], based on a typical specification of a Reid vapor pressure of 12.5 psia [86 kPa(a)] for the stabilized condensate bottom product. It is cooled to 135° F. [57° C.] in cooler 126 before flowing to storage. The stabilizer overhead vapor (stream 21) enters condenser 123 where it is cooled from 161° F. [72° C.] to 142° F. [61° C.]. Partially condensed stream 21*a* then enters reflux drum 124 where the vapor (stream 22) is separated from the condensed liquid (stream 23). Reflux pump 125 pumps liquid stream 23 to higher pressure so that stream 23*a* can be returned to column 121 at the top column feed position. Vapor stream 22 is compressed to higher pressure by compressor 127 so that stream 22*a* at 250° F. [121° C.] can combine with compressed debutanizer overhead stream 19*b* at 140° F. [60° C.] to form combined stream 25.

Returning to hydrocarbon recovery column 108, vapor stream 13 from reflux drum 110 enters heat exchanger 109 and is cooled to −220° F. [−140° C.]. The resulting condensed stream 13*a* is then flash expanded by expansion valve 133 to the operating pressure (approximately 175 psia [1,205 kPa(a)]) of separator 134. A portion of the stream is vaporized, cooling stream 13*b* to −238° F. [−150° C.] before it enters separator 134 where the vapor (stream 33) is separated from the condensed liquid (stream 34).

Vapor stream 33 enters heat exchanger 135 and is cooled to −300° F. [−184° C.] and condensed by heat exchange with cold nitrogen (stream 35), pumped column bottom liquid stream 37*a*, and reboiler liquids (stream 36) from nitrogen column 138. Condensed stream 33*a* is then flash expanded by expansion valve 136 to the operating pressure (approximately 32 psia [219 kPa(a)]) of nitrogen column 138. A portion of the stream is vaporized, cooling stream 33*b* to −302° F. [−186° C.] before it is supplied to column 138 as cold reflux at the top column feed position. Liquid stream 34 is likewise directed to heat exchanger 135 and is cooled to −265° F. [−165° C.] (stream 34*a*) and then flash expanded by expansion valve 137 to the operating pressure of nitrogen column 138. A portion of the stream is vaporized, cooling stream 34*b* to −285° F. [−176° C.] before it is supplied to the column at a mid-column feed position.

Tower 138 is a conventional distillation column containing a plurality of vertically spaced trays, one or more packed beds, or some combination of trays and packing. The heat input for the reboiler in its lower stripping section is provided by supplying distillation liquid stream 36 to heat exchanger 135, heating it from −278° F. [−172° C.] to −257° F. [−160° C.] by providing cooling to streams 33 and 34 as described previously, whereupon stream 36*a* returns to column 138. The reboiling in the bottom of nitrogen column 138 is regulated by control means 154 to limit the amount of nitrogen leaving the column in bottom liquid stream 37, as part of the hydrocarbon residue gas from the process (stream 41) is produced by vaporizing this liquid. Bottom liquid product stream 37 at −257° F. [−160° C.] is pumped to higher pressure by pump 140 and stream 37*a* flows to heat exchanger 135 to be heated as it provides cooling to streams 33 and 34 as described previously. Heated stream 37*b* flows to heat exchanger 109 where it is heated to −164° F. [−109° C.] and vaporized (stream 37*c*) and then to heat exchanger 106 where it is heated to 133° F. [56° C.] (stream 37*d*) as it provides cooling to streams 13 and 11 as described previously.

The column overhead vapor (cold nitrogen vent stream 35), containing only 1.5 mole % methane due to the rectification provided by cold top feed stream 33*b*, leaves nitrogen column 138 at −303° F. [−186° C.]. It flows to heat exchanger 135 where it is heated to −264° F. [−165° C.] (stream 35*a*), to heat exchanger 109 where it is heated to −164° F. [−109° C.] (stream 35*b*), and to heat exchanger 106 where it is heated to 133° F. [56° C.] (stream 35*c*) as it provides cooling to streams 33, 34, 13, and 11 as described previously.

The warmed vaporized hydrocarbon stream 37*d* from nitrogen column 138 is compressed to 295 psia [2,032 kPa(a)] (stream 37*e*) in compressor 141 and cooled to 135° F. [57° C.] (stream 37*f*) in cooler 142 before being combined with warm open loop refrigerant stream 39*e* to form stream 38. Stream 38 is then compressed in two stages (compressors 143 and 145) to the residue gas pipeline pressure (1365 psia [9,411 kPa(a)]), with cooling after each stage (coolers 144 and 146) to 135° F. [57° C.]. A portion of cooled compressed stream 38*d* is withdrawn as open loop refrigerant stream 39 and is cooled to −170° F. [−112° C.] and condensed in heat exchangers 106 and 109 by the nitrogen and hydrocarbon streams as described previously. The resulting liquid stream 39*b* is then expanded to lower pressure by expansion valve 147, cooling stream 39*c* to −173° F. [−114° C.]. The control device 167 controls the expansion valve 147 based on the comparison of the temperature of the partially condensed stream 12*a* to the setpoint. If the temperature of the partially condensed stream 12*a* is lower than the setpoint, the control device 167 signals the expansion valve 147 to open an appropriate amount to provide less cooling thereby adjusting the pressure in a cold open loop refrigerant stream 39*c* to a higher pressure. If the temperature of the partially condensed stream 12*a* is higher than the setpoint, the control device 167 signals the expansion valve 147 to close an appropriate amount to provide more cooling thereby adjusting the pressure in the cold open loop refrigerant stream 39*c* to a lower pressure. Cold open loop refrigerant stream 39*c* is then heated to 133° F. [56° C.] and re-vaporized in heat exchangers 109 and 106 as it provides cooling to streams 13, 39*a*, 11, and 39 as described previously to form warm open loop refrigerant stream 39*e*.

Combined stream 25 at 142° F. [61° C.] is compressed in two stages (compressors 149 and 151) to the residue gas pipeline pressure, with cooling after each stage (coolers 150 and 152) to 135° F. [57° C.]. Cooled compressed stream 25*d* then combines with the remaining portion (stream 40) of cooled compressed stream 38*d* to form residue gas stream 41, which flows to the gas transmission pipeline at 135° F. [57° C.] and 1365 psia [9,411 kPa(a)].

A summary of stream flow rates and energy consumption for the process illustrated in FIGS. 2*a*/2*b* is set forth in the following Table II:

TABLE II (FIGS. 2a/2b)
Stream Flow Summary - Lb. Moles/Hr [kg moles/Hr]

| Stream | Nitrogen | $CO_2$ | Methane | Ethane | Propane. | Butane+ | Total |
|---|---|---|---|---|---|---|---|
| 10 | 2,800 | 222 | 16,710 | 1,232 | 512 | 485 | 21,961 |
| 11 | 2,800 | 222 | 16,710 | 1,232 | 512 | 485 | 21,961 |
| 12 | 3,600 | 0 | 10,076 | 0 | 0 | 0 | 13,676 |
| 13 | 2,491 | 0 | 4,019 | 0 | 0 | 0 | 6,510 |
| 14 | 1,109 | 0 | 6,057 | 0 | 0 | 0 | 7,166 |
| 16 | 309 | 222 | 12,691 | 1,232 | 512 | 485 | 15,451 |
| 17 | 308 | 219 | 12,620 | 1,191 | 454 | 257 | 15,049 |
| 18 | 1 | 3 | 71 | 41 | 58 | 228 | 402 |
| 19 | 309 | 222 | 12,691 | 1,223 | 457 | 250 | 15,152 |
| 20 | 0 | 0 | 0 | 9 | 55 | 235 | 299 |
| 21 | 0 | 0 | 0 | 11 | 89 | 243 | 343 |
| 22 | 0 | 0 | 0 | 9 | 55 | 92 | 156 |
| 23 | 0 | 0 | 0 | 2 | 34 | 151 | 187 |
| 25 | 309 | 222 | 12,691 | 1,232 | 512 | 342 | 15,308 |
| 33 | 803 | 0 | 196 | 0 | 0 | 0 | 999 |

TABLE II-continued (FIGS. 2a/2b)
Stream Flow Summary - Lb. Moles/Hr [kg moles/Hr]

| | | | | | | | |
|---|---|---|---|---|---|---|---|
| 34 | 1,688 | 0 | 3,823 | 0 | 0 | 0 | 5,511 |
| 37 | 210 | 0 | 3,984 | 0 | 0 | 0 | 4,193 |
| 38 | 511 | 0 | 9,718 | 0 | 0 | 0 | 10,228 |
| 39 | 301 | 0 | 5,734 | 0 | 0 | 0 | 6,035 |
| 40 | 210 | 0 | 3,984 | 0 | 0 | 0 | 4,193 |
| 35 | 2,281 | 0 | 35 | 0 | 0 | 0 | 2,317 |
| 41 | 519 | 222 | 16,675 | 1,232 | 512 | 342 | 19,501 |
| 24 | 0 | 0 | 0 | 0 | 0 | 143 | 143 |

Performance*

| | | |
|---|---|---|
| Nitrogen in Residue Gas | 2.7 mole % | |
| Carbon Dioxide in Residue Gas | 1.1 mole % | |
| HC Dewpoint of Residue Gas | 12° F. | [−11° C.] |
| Methane in Nitrogen Vent | 1.5 mole % | |
| Reid Vap. Pres. of Condensate | 12.0 PSIA | [83 kPa(a)] |

Power

| | | |
|---|---|---|
| Inlet Gas Compression | 14,599 HP | [24,000 kW] |
| Stabilizer Ovdh. Compression | 91 HP | [150 kW] |
| Residue Gas Compression | 22,890 HP | [37,631 kW] |
| Total Compression | 37,580 HP | [61,781 kW] |

*(Based on un-rounded flow rates)

A comparison of Tables I and II shows that, compared to the base case process, the present invention makes a cleaner separation between the nitrogen and the hydrocarbons, reducing the nitrogen in the residue gas from 3.9% to 2.7% and reducing the methane in the nitrogen vent stream from 2.0% to 1.5%. Comparison of Tables I and II further shows that this better separation was achieved using about 6% less power than the base case process. In addition, the present invention does not require removing carbon dioxide from the feed gas, eliminating the significant capital and operating expense of the AGRU required by the base case process.

The key difference in the present invention compared to the base case process in FIGS. 1*a*/1*b* is the processing that occurs in hydrocarbon recovery column 108 in FIG. 2*a*. First, this column captures most of the methane, ethane, and propane in the feed gas at relatively high pressure, reducing the residue gas compression power when stream 16 is subsequently fractionated in debutanizer column 117 and heated (stream 19*a*). Second, the relative volatility of carbon dioxide lies between that of methane and ethane, so operating column 108 such that the majority of the methane leaves in bottom liquid product stream 16 means essentially none of the carbon dioxide leaves the column in overhead product stream 12. As a result, there is no carbon dioxide to freeze out in the downstream nitrogen column 138. Third, all of the butane and heavier components in the feed gas are still present in column 108, which helps suppress freezing of carbon dioxide in this column. And fourth, the higher column operating pressure means the column temperatures are warmer, keeping them above the temperatures at which carbon dioxide will freeze at the concentrations found in this column. Contrast this to the processing sequence in the base case process of FIGS. 1*a*/1*b*, where the first step is to remove the butane and heavier components from the feed gas in stabilizer column 121, and then to recover the lighter hydrocarbons in nitrogen column 129. Nitrogen column 129 is operated at much lower pressure than hydrocarbon recovery column 108 in the present invention, resulting in much colder temperatures in this column. Since the column is colder and has none of the butane and heavier components to act as a freezing suppressant, all of the carbon dioxide must be removed in unit 104 to prevent carbon dioxide freezing. Hence the need for the AGRU in the base case process of FIGS. 1*a*/1*b* that is not required with the present invention.

Example 2

Some circumstances may favor reducing the methane concentration in the nitrogen vent below that of the FIGS. 2*a*/2*b* embodiment of the present invention. In such circumstances, the embodiment shown in FIGS. 3*a*/3*b* may be employed. The feed gas composition and conditions considered in the process presented in FIGS. 3*a*/3*b* are the same as those in the FIGS. 1*a*/1*b* and FIGS. 2*a*/2*b* processes. Accordingly, the FIGS. 3*a*/3*b* process can be compared with that of the FIGS. 1*a*/1*b* process and the FIGS. 2*a*/2*b* embodiment to illustrate the advantages of this embodiment of the present invention.

Figure 3A:
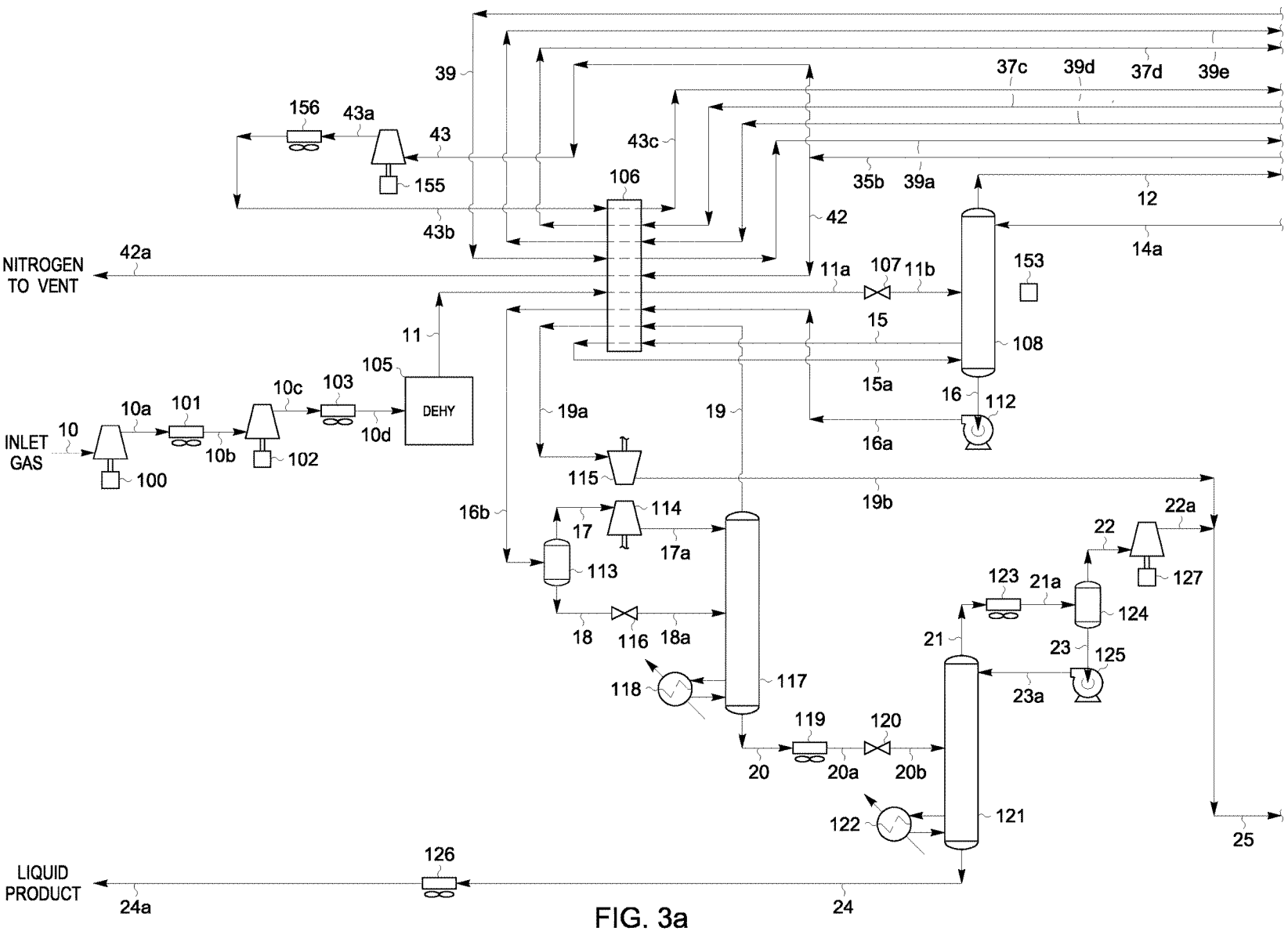
FIGS. 3*a*/3*b*, 4*a*/4*b*, 5*a*/5*b*, 6*a*/6*b*, 7*a*/7*b*, and 8*a*/8*b* are flow diagrams illustrating alternative means of application of the present invention to a gas stream.
Figure 3B:
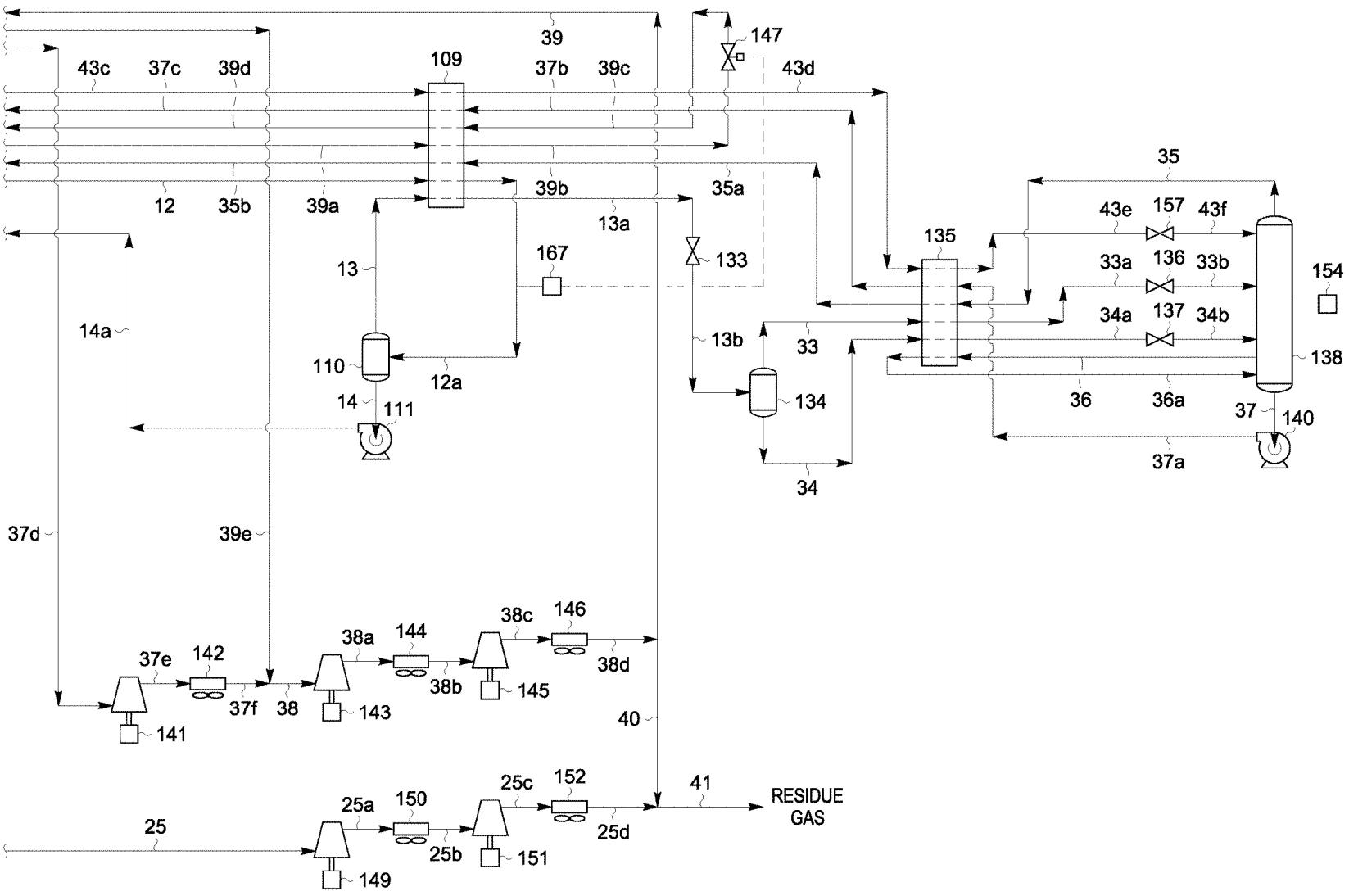

The processing of feed stream 10 in the FIGS. 3*a*/3*b* embodiment of the present invention occurs under much the same conditions as for the FIGS. 2*a*/2*b* embodiment. The key difference is the processing that occurs in nitrogen column 138. Instead of supplying flash expanded stream 33*b* to column 138 at the top column feed position, it is instead supplied to the column at an upper mid-column feed position, above that of the mid-column feed position of flash expanded stream 34*b*.

A small portion (stream 43) is withdrawn from the partially heated nitrogen column overhead vapor stream 35*b* to become a reflux stream for nitrogen column 138. The remainder (stream 42) continues to heat exchanger 106 and is heated as described previously for FIGS. 2*a*/2*b* to form nitrogen vent stream 42*a*. Stream 43 is compressed to 255 psia [1,758 kPa(a)] in compressor 155 and cooled to 135° F. [57° C.] in cooler 156 (stream 43*b*). Stream 43*b* is then cooled and condensed in heat exchangers 106, 109, and 135. Cooled and condensed stream 43*e* at −304° F. [−187° C.] is flash expanded to the operating pressure (approximately 32 psia [218 kPa(a)]) of nitrogen column 138 by expansion valve 157. A portion of the stream is vaporized, cooling stream 43*e* to −306° F. [−188° C.] before it is supplied to column 138 at the top column feed position. This cold reflux is nearly pure nitrogen, providing additional rectification in nitrogen column 138 so that its overhead vapor (stream 35) contains very little methane (less than 0.1 mole %). The column overhead vapor (stream 35) and the column bottom liquid (stream 37) are processed much the same as before in the FIGS. 2*a*/2*b* embodiment of the present invention.

A summary of stream flow rates and energy consumption for the process illustrated in FIGS. 3*a*/3*b* is set forth in the following Table III:

TABLE III (FIGS. 3a/3b)
Stream Flow Summary - Lb. Moles/Hr [kg moles/Hr]

| Stream | Nitrogen | $CO_2$ | Methane | Ethane | Propane. | Butane+ | Total |
|---|---|---|---|---|---|---|---|
| 10 | 2,800 | 222 | 16,710 | 1,232 | 512 | 485 | 21,961 |
| 11 | 2,800 | 222 | 16,710 | 1,232 | 512 | 485 | 21,961 |
| 12 | 3,016 | 0 | 6,897 | 0 | 0 | 0 | 9,914 |
| 13 | 2,490 | 0 | 3,988 | 0 | 0 | 0 | 6,479 |
| 14 | 526 | 0 | 2,909 | 0 | 0 | 0 | 3,435 |
| 16 | 310 | 222 | 12,722 | 1,232 | 512 | 485 | 15,482 |
| 17 | 309 | 218 | 12,645 | 1,188 | 449 | 248 | 15,055 |
| 18 | 1 | 4 | 77 | 44 | 63 | 237 | 427 |
| 19 | 310 | 222 | 12,722 | 1,222 | 446 | 223 | 15,144 |
| 20 | 0 | 0 | 0 | 10 | 65 | 262 | 338 |
| 21 | 0 | 0 | 0 | 12 | 96 | 240 | 348 |
| 22 | 0 | 0 | 0 | 10 | 65 | 105 | 181 |
| 23 | 0 | 0 | 0 | 2 | 31 | 134 | 167 |
| 25 | 310 | 222 | 12,722 | 1,232 | 512 | 328 | 15,325 |
| 33 | 1,371 | 0 | 536 | 0 | 0 | 0 | 1,907 |
| 34 | 1,119 | 0 | 3,452 | 0 | 0 | 0 | 4,572 |
| 37 | 81 | 0 | 3,987 | 0 | 0 | 0 | 4,069 |
| 38 | 205 | 0 | 10,032 | 0 | 0 | 0 | 10,236 |
| 39 | 123 | 0 | 6,044 | 0 | 0 | 0 | 6,168 |
| 40 | 81 | 0 | 3,988 | 0 | 0 | 0 | 4,069 |
| 35 | 2,908 | 0 | 1 | 0 | 0 | 0 | 2,909 |
| 43 | 499 | 0 | 0 | 0 | 0 | 0 | 499 |
| 42 | 2,409 | 0 | 1 | 0 | 0 | 0 | 2,410 |
| 41 | 391 | 222 | 16,709 | 1,232 | 512 | 328 | 19,394 |
| 24 | 0 | 0 | 0 | 0 | 0 | 157 | 157 |

Performance*

| | | |
|---|---|---|
| Nitrogen in Residue Gas | 2.0 mole % | |
| Carbon Dioxide in Residue Gas | 1.1 mole % | |
| HC Dewpoint of Residue Gas | 5° F. | [−15° C.] |
| Methane in Nitrogen Vent | 0.05 mole % | |
| Reid Vap. Pres. of Condensate | 13.6 PSIA | [94 kPa(a)] |
| Power | | |
| Inlet Gas Compression | 14,599 HP | [24,000 kW] |
| Stabilizer Ovdh. Compression | 100 HP | [164 kW] |
| Nitrogen Reflux Compression | 515 HP | [847 kW] |
| Residue Gas Compression | 25,119 HP | [41,295 kW] |
| Total Compression | 40,333 HP | [66,306 kW] |

*(Based on un-rounded flow rates)

A comparison of Tables I and III shows that, compared to the base case process, this embodiment of the present invention makes an even cleaner separation between the nitrogen and the hydrocarbons, reducing the nitrogen in the residue gas from 3.9% to 2.0% and reducing the methane in the nitrogen vent stream from 2.0% to 0.05%. Comparison of Tables I and III further shows that this better separation was achieved using less than 1% more power than the base case process.

The key feature allowing this embodiment of the present invention to efficiently reduce the hydrocarbon loss in the nitrogen vent stream is the reflux for nitrogen column 138 generated using compressor 155. It is nearly pure nitrogen, allowing it to rectify the vapors in the top of the column so that hardly any methane escapes.

Example 3

Figure 4A:
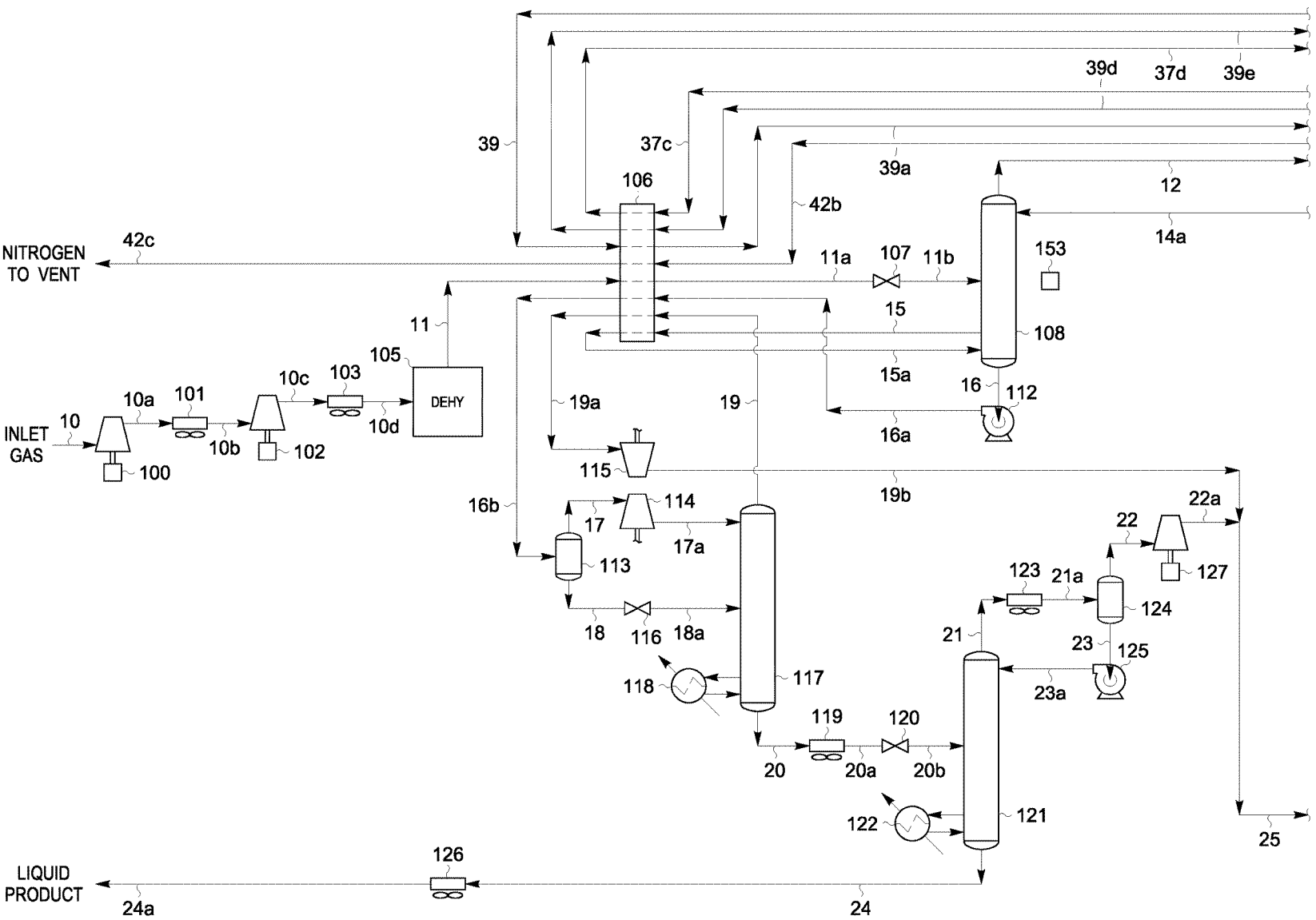
Figure 4B:
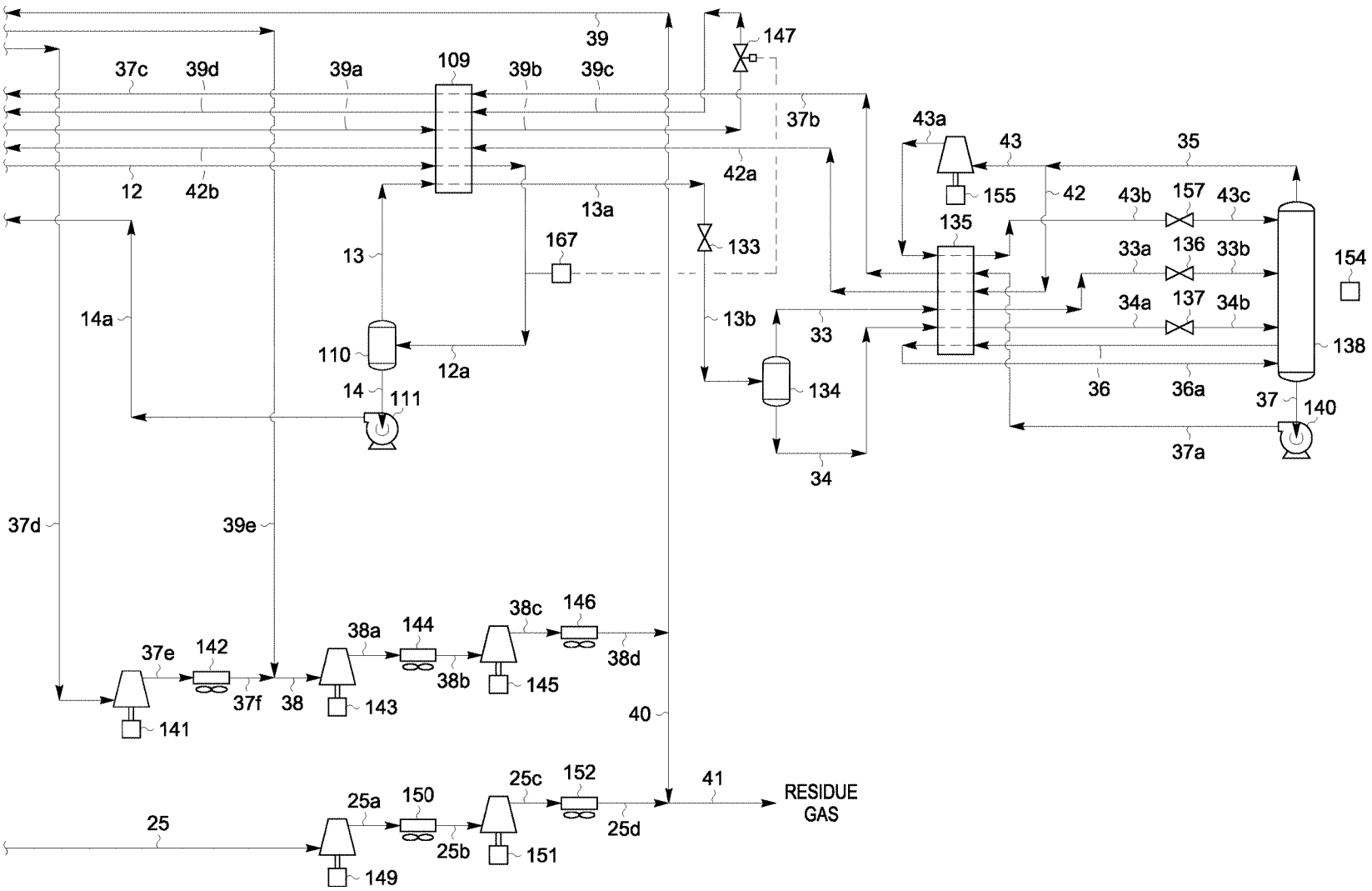

Another embodiment for reducing the methane concentration in the nitrogen vent below that of the FIGS. 2*a*/2*b* embodiment of the present invention is shown in FIGS. 4*a*/4*b*. The feed gas composition and conditions considered in the process presented in FIGS. 4*a*/4*b* are the same as those in the FIGS. 1*a*/1*b*, FIGS. 2*a*/2*b*, and FIGS. 3*a*/3*b* processes. Accordingly, the FIGS. 4*a*/4*b* process can be compared with that of the FIGS. 1*a*/1*b* process and the FIGS. 2*a*/2*b* and FIGS. 3*a*/3*b* embodiments to illustrate the advantages of this embodiment of the present invention.

The processing of feed stream 10 in the FIGS. 4*a*/4*b* embodiment of the present invention occurs under much the same conditions as for the FIGS. 3*a*/3*b* embodiment. The main difference is the manner in which the cold liquid nitrogen reflux stream for nitrogen column 138 is provided. In the FIGS. 4*a*/4*b* embodiment, a small portion (stream 43) is withdrawn from cold nitrogen column overhead vapor stream 35, while the remainder (stream 42) continues to heat exchangers 135, 109, and 106 and is heated as described previously for stream 35 in the FIGS. 2*a*/2*b* embodiment to form nitrogen vent stream 42*c*.

Stream 43 is compressed to 90 psia [621 kPa(a)] in compressor 155 and then cooled and condensed in heat exchanger 135. Cooled and condensed stream 43*b* at −305° F. [−187° C.] is flash expanded to the operating pressure (approximately 30 psia [210 kPa(a)]) of nitrogen column 138 by expansion valve 156. A portion of the stream is vaporized, cooling stream 43*e* to −307° F. [−188° C.] before it is supplied to column 138 at the top column feed position. This cold reflux is nearly pure nitrogen, providing additional rectification in nitrogen column 138 so that its overhead vapor (stream 35) contains very little methane (less than 0.1 mole %). The column bottom liquid (stream 37) is processed much the same as before in the FIGS. 2*a*/2*b* and FIGS. 3*a*/3*b* embodiments of the present invention.

A summary of stream flow rates and energy consumption for the process illustrated in FIGS. 4*a*/4*b* is set forth in the following Table IV:

TABLE IV (FIGS. 4a/4b)
Stream Flow Summary - Lb. Moles/Hr [kg moles/Hr]

| Stream | Nitrogen | $CO_2$ | Methane | Ethane | Propane. | Butane+ | Total |
|---|---|---|---|---|---|---|---|
| 10 | 2,800 | 222 | 16,710 | 1,232 | 512 | 485 | 21,961 |
| 11 | 2,800 | 222 | 16,710 | 1,232 | 512 | 485 | 21,961 |
| 12 | 3,708 | 0 | 10,774 | 0 | 0 | 0 | 14,483 |
| 13 | 2,491 | 0 | 4,010 | 0 | 0 | 0 | 6,501 |
| 14 | 1,217 | 0 | 6,764 | 0 | 0 | 0 | 7,982 |
| 16 | 309 | 222 | 12,700 | 1,232 | 512 | 485 | 15,460 |
| 17 | 308 | 218 | 12,608 | 1,179 | 438 | 232 | 14,984 |
| 18 | 1 | 4 | 92 | 53 | 74 | 253 | 476 |
| 19 | 309 | 222 | 12,700 | 1,222 | 440 | 217 | 15,110 |
| 20 | 0 | 0 | 0 | 10 | 72 | 268 | 350 |
| 21 | 0 | 0 | 0 | 14 | 133 | 336 | 482 |
| 22 | 0 | 0 | 0 | 10 | 72 | 107 | 189 |
| 23 | 0 | 0 | 0 | 4 | 62 | 228 | 293 |
| 25 | 309 | 222 | 12,700 | 1,232 | 512 | 324 | 15,299 |
| 33 | 1,285 | 0 | 496 | 0 | 0 | 0 | 1,751 |
| 34 | 1,206 | 0 | 3,544 | 0 | 0 | 0 | 4,750 |
| 37 | 82 | 0 | 4,009 | 0 | 0 | 0 | 4,091 |
| 38 | 224 | 0 | 10,984 | 0 | 0 | 0 | 11,209 |
| 39 | 142 | 0 | 6,975 | 0 | 0 | 0 | 7,117 |
| 40 | 82 | 0 | 4,009 | 0 | 0 | 0 | 4,091 |
| 35 | 2,785 | 0 | 1 | 0 | 0 | 0 | 2,786 |
| 43 | 376 | 0 | 0 | 0 | 0 | 0 | 376 |
| 42 | 2,409 | 0 | 1 | 0 | 0 | 0 | 2,410 |
| 41 | 391 | 222 | 16,709 | 1,232 | 512 | 324 | 19,390 |
| 24 | 0 | 0 | 0 | 0 | 0 | 161 | 161 |

Performance*

| | | |
|---|---|---|
| Nitrogen in Residue Gas | 2.0 mole % | |
| Carbon Dioxide in Residue Gas | 1.1 mole % | |
| HC Dewpoint of Residue Gas | 5° F. | [−15° C.] |
| Methane in Nitrogen Vent | 0.05 mole % | |
| Reid Vap. Pres. of Condensate | 10.8 PSIA | [75 kPa(a)] |

Power

| | | |
|---|---|---|
| Inlet Gas Compression | 14,599 HP | [24,000 kW] |
| Stabilizer Ovdh. Compression | 100 HP | [164 kW] |
| Nitrogen Reflux Compression | 70 HP | [115 kW] |
| Residue Gas Compression | 25,452 HP | [41,843 kW] |
| Total Compression | 40,221 HP | [66,122 kW] |

*(Based on un-rounded flow rates)

A comparison of Tables I and IV shows that, compared to the base case process, this embodiment of the present invention also makes a very clean separation between the nitrogen and the hydrocarbons, reducing the nitrogen in the residue gas from 3.9% to 2.0% and reducing the methane in the nitrogen vent stream from 2.0% to 0.05%. Comparison of Tables I and IV further shows that this better separation was achieved using less than 1% more power than the base case process.

The key feature allowing this embodiment of the present invention to even more efficiently reduce the hydrocarbon loss in the nitrogen vent stream is the reflux for nitrogen column 138 generated using compressor 155. It is nearly pure nitrogen, allowing it to rectify the vapors in the top of the column so that hardly any methane escapes. And, because the nitrogen being compressed is very cold, the power requirement of compressor 155 is lower than for the FIGS. 3*a*/3*b* embodiment of the present invention.

Example 4

Another method for reducing the methane concentration in the nitrogen vent below that of the FIGS. 2*a*/2*b* embodiment of the present invention is the embodiment shown in FIGS. 5*a*/5*b*. The feed gas composition and conditions considered in the process presented in FIGS. 5*a*/5*b* are the same as those in the FIGS. 1*a*/1*b*, FIGS. 2*a*/2*b*, FIGS. 3*a*/3*b*, and FIGS. 4*a*/4*b* processes. Accordingly, the FIGS. 5*a*/5*b* process can be compared with that of the FIGS. 1*a*/1*b* process and the FIGS. 2*a*/2*b*, FIGS. 3*a*/3*b*, and FIGS. 4*a*/4*b* embodiments to illustrate the advantages of this embodiment of the present invention.

Figure 5A:
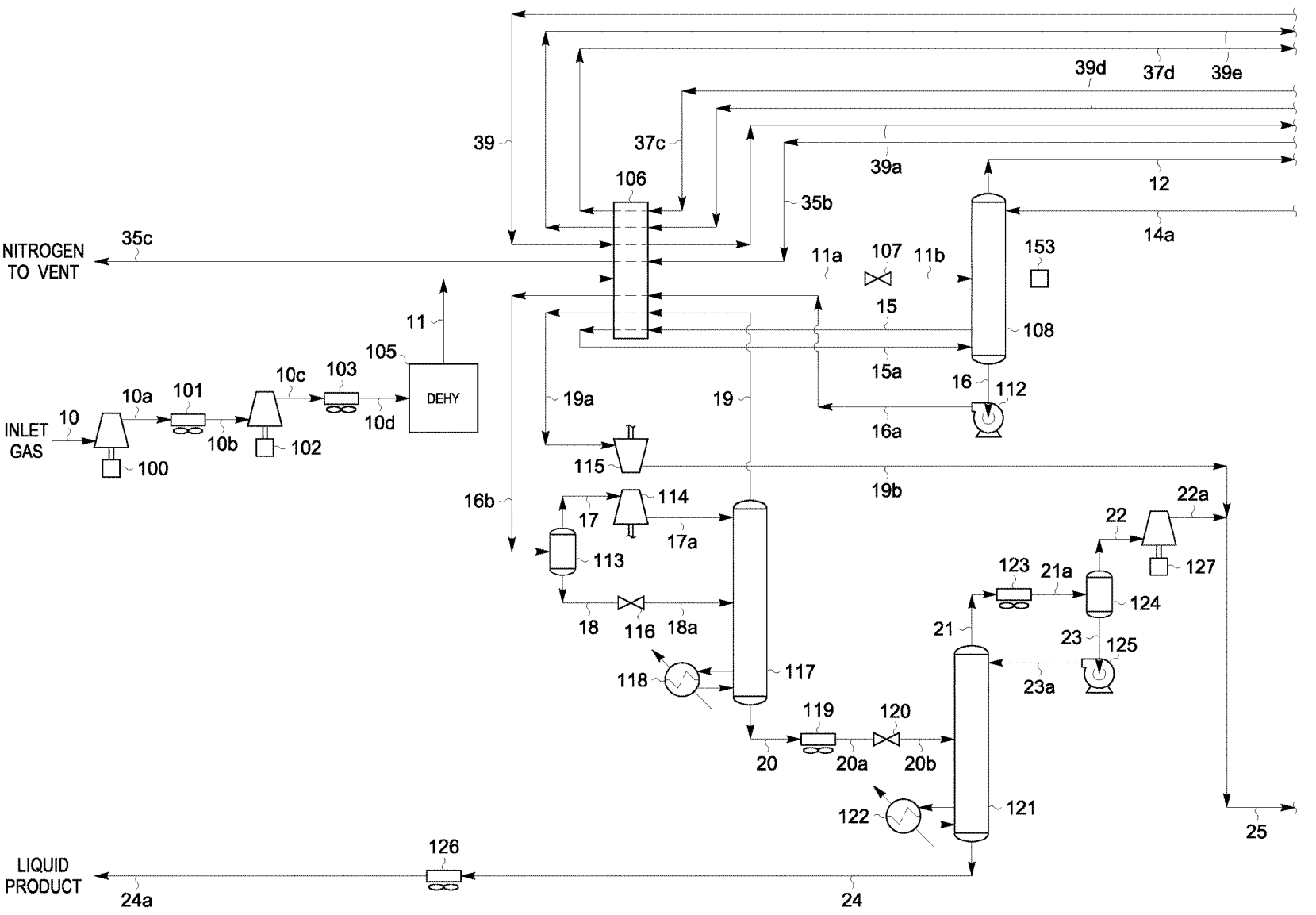
Figure 5B:
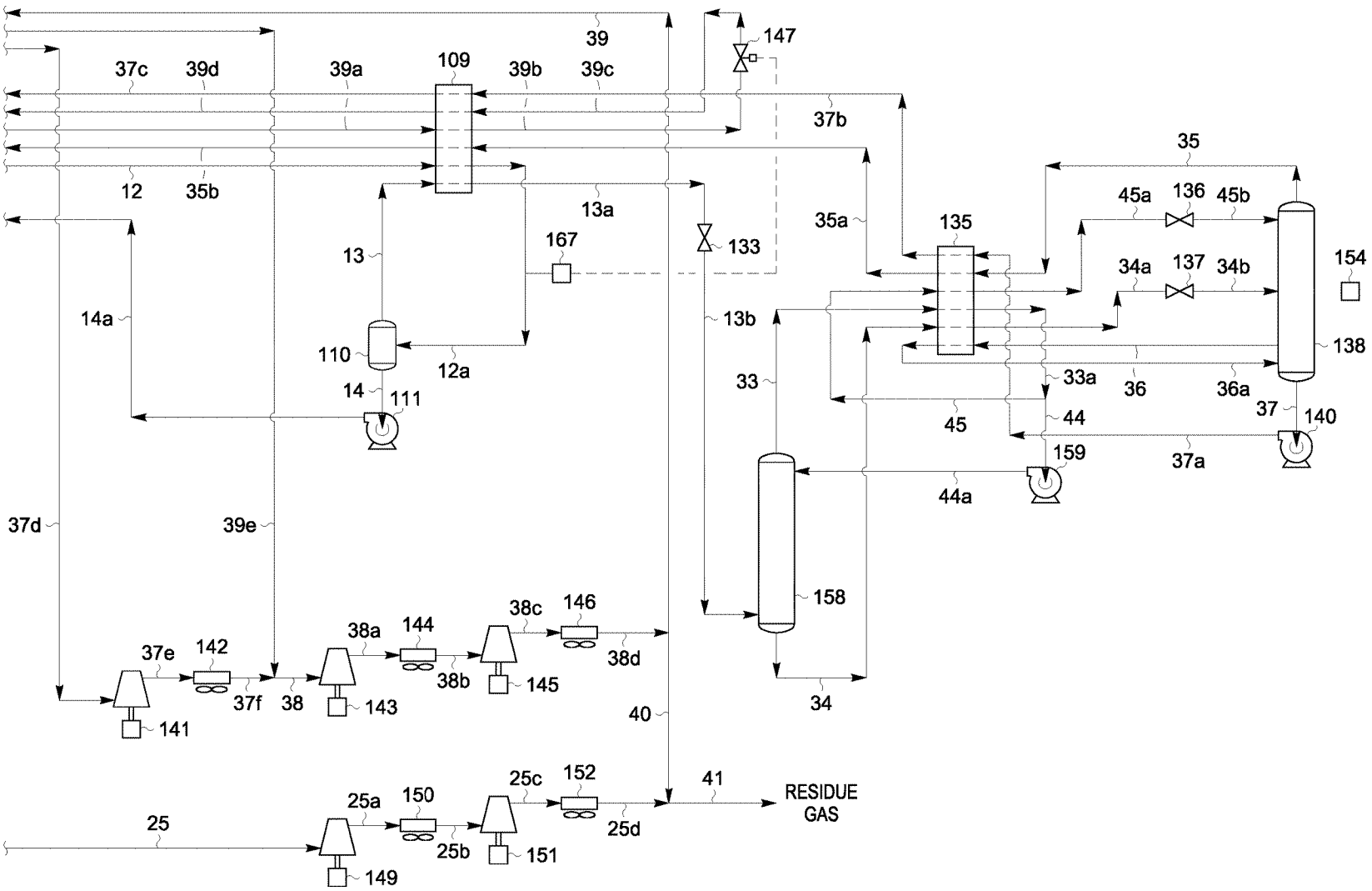

The processing of feed stream 10 in the FIGS. 5*a*/5*b* embodiment of the present invention occurs under much the same conditions as for the FIGS. 2*a*/2*b* embodiment. The key difference is replacing separator 134 in the FIGS. 2*a*/2*b* embodiment with refluxed absorber column 158 in the FIGS. 5*a*/5*b* embodiment to produce a better reflux stream for nitrogen column 138. Cooled stream 13*a* at −196° F. [−126° C.] is flash expanded by expansion valve 133 to the operating pressure (approximately 316 psia [2,178 kPa(a)]) of column 158. A portion of the stream is vaporized, cooling stream 13*b* to −206° F. [−132° C.] before it is supplied to column 158 at a bottom feed position. Absorber overhead vapor stream 33 at −248° F. [−156° C.] enters heat exchanger 135 and is cooled to −258° F. [−161° C.] and condensed. The condensed stream 33*a* is divided into two portions, stream 44 and stream 45. Reflux pump 159 pumps liquid stream 44 to higher pressure so that stream 44*a* can be returned to absorber column 158 at the top column feed position. This cold liquid reflux provides rectification so that overhead stream 33 contains very little methane (less than 1 mole %).

The other portion of condensed stream 33*a*, liquid stream 45, is cooled to −304° F. [−187° C.] in heat exchanger 135 and then flash expanded to the operating pressure (approximately 30 psia [205 kPa(a)]) of nitrogen column 138 by expansion valve 136. A portion of the stream is vaporized, cooling stream 45*b* to −307° F. [−188° C.] before it is supplied to column 138 at the top column feed position. This cold reflux is nearly pure nitrogen, providing rectification in nitrogen column 138 so that its overhead vapor (stream 35) contains very little methane (less than 0.1 mole %). The column overhead vapor (stream 35) and the column bottom liquid (stream 37) are processed much the same as before in the FIGS. 2*a*/2*b* embodiment of the present invention.

A summary of stream flow rates and energy consumption for the process illustrated in FIGS. 5*a*/5*b* is set forth in the following Table V:

TABLE V (FIGS. 5a/5b)
Stream Flow Summary - Lb. Moles/Hr [kg moles/Hr]

| Stream | Nitrogen | $CO_2$ | Methane | Ethane | Propane. | Butane+ | Total |
|---|---|---|---|---|---|---|---|
| 10 | 2,800 | 222 | 16,710 | 1,232 | 512 | 485 | 21,961 |
| 11 | 2,800 | 222 | 16,710 | 1,232 | 512 | 485 | 21,961 |
| 12 | 3,819 | 0 | 11,917 | 0 | 0 | 0 | 15,376 |
| 13 | 2,495 | 0 | 4,208 | 0 | 0 | 0 | 6,703 |
| 14 | 1,325 | 0 | 7,709 | 0 | 0 | 0 | 9,033 |
| 16 | 305 | 222 | 12,501 | 1,232 | 512 | 485 | 15,257 |
| 17 | 304 | 218 | 12,416 | 1,182 | 442 | 237 | 14,800 |
| 18 | 1 | 4 | 85 | 50 | 70 | 248 | 457 |
| 19 | 305 | 222 | 12,501 | 1,222 | 445 | 224 | 14,919 |
| 20 | 0 | 0 | 0 | 10 | 67 | 261 | 338 |
| 21 | 0 | 0 | 0 | 13 | 116 | 278 | 407 |
| 22 | 0 | 0 | 0 | 10 | 67 | 99 | 176 |
| 23 | 0 | 0 | 0 | 3 | 49 | 179 | 231 |
| 25 | 305 | 222 | 12,501 | 1,232 | 512 | 324 | 15,096 |
| 33 | 2,309 | 0 | 15 | 0 | 0 | 0 | 2,324 |
| 44 | 1,523 | 0 | 10 | 0 | 0 | 0 | 1,533 |
| 45 | 785 | 0 | 5 | 0 | 0 | 0 | 790 |
| 34 | 1,709 | 0 | 4,203 | 0 | 0 | 0 | 5,912 |
| 37 | 86 | 0 | 4,206 | 0 | 0 | 0 | 4,292 |
| 38 | 211 | 0 | 10,361 | 0 | 0 | 0 | 10,572 |
| 39 | 126 | 0 | 6,154 | 0 | 0 | 0 | 6,280 |
| 40 | 86 | 0 | 4,206 | 0 | 0 | 0 | 4,292 |
| 35 | 2,409 | 0 | 1 | 0 | 0 | 0 | 2,409 |
| 41 | 391 | 222 | 16,709 | 1,232 | 512 | 324 | 19,391 |
| 24 | 0 | 0 | 0 | 0 | 0 | 161 | 161 |

Performance*

| | | |
|---|---|---|
| Nitrogen in Residue Gas | 2.0 mole % | |
| Carbon Dioxide in Residue Gas | 1.1 mole % | |
| HC Dewpoint of Residue Gas | 5° F. | [−15° C.] |
| Methane in Nitrogen Vent | 0.06 mole % | |
| Reid Vap. Pres. of Condensate | 11.5 PSIA | [79 kPa(a)] |

Power

| | | |
|---|---|---|
| Inlet Gas Compression | 14,599 HP | [24,000 kW] |
| Stabilizer Ovdh. Compression | 91 HP | [150 kW] |
| Residue Gas Compression | 24,858 HP | [40,866 kW] |
| Total Compression | 39,548 HP | [65,016 kW] |

*(Based on un-rounded flow rates)

A comparison of Tables I and V shows that, compared to the base case process, this embodiment of the present invention also makes a very clean separation between the nitrogen and the hydrocarbons, reducing the nitrogen in the residue gas from 3.9% to 2.0% and reducing the methane in the nitrogen vent stream from 2.0% to 0.06%. Comparison of Tables I and V further shows that this better separation was achieved using less power than the base case process. The key feature allowing this embodiment of the present invention to even more efficiently reduce the hydrocarbon loss in the nitrogen vent stream is using refluxed absorber column 158 to produce the reflux for nitrogen column 138. Reflux stream 45*b* is nearly pure nitrogen, allowing it to rectify the vapors in the top of the column so that hardly any methane escapes. And, because no compression is used to generate this reflux, the power requirement for this embodiment of the invention is lower than for the FIGS. 3*a*/3*b* and FIGS. 4*a*/4*b* embodiments of the present invention. Additionally, with proper selection of the operating pressures of absorber column 158 and nitrogen column 138, the temperatures are such that the reboiling duty of column 138 can provide the condensing duty for column 158, reducing the capital cost of the plant.

Other Embodiments

Figure 6A:
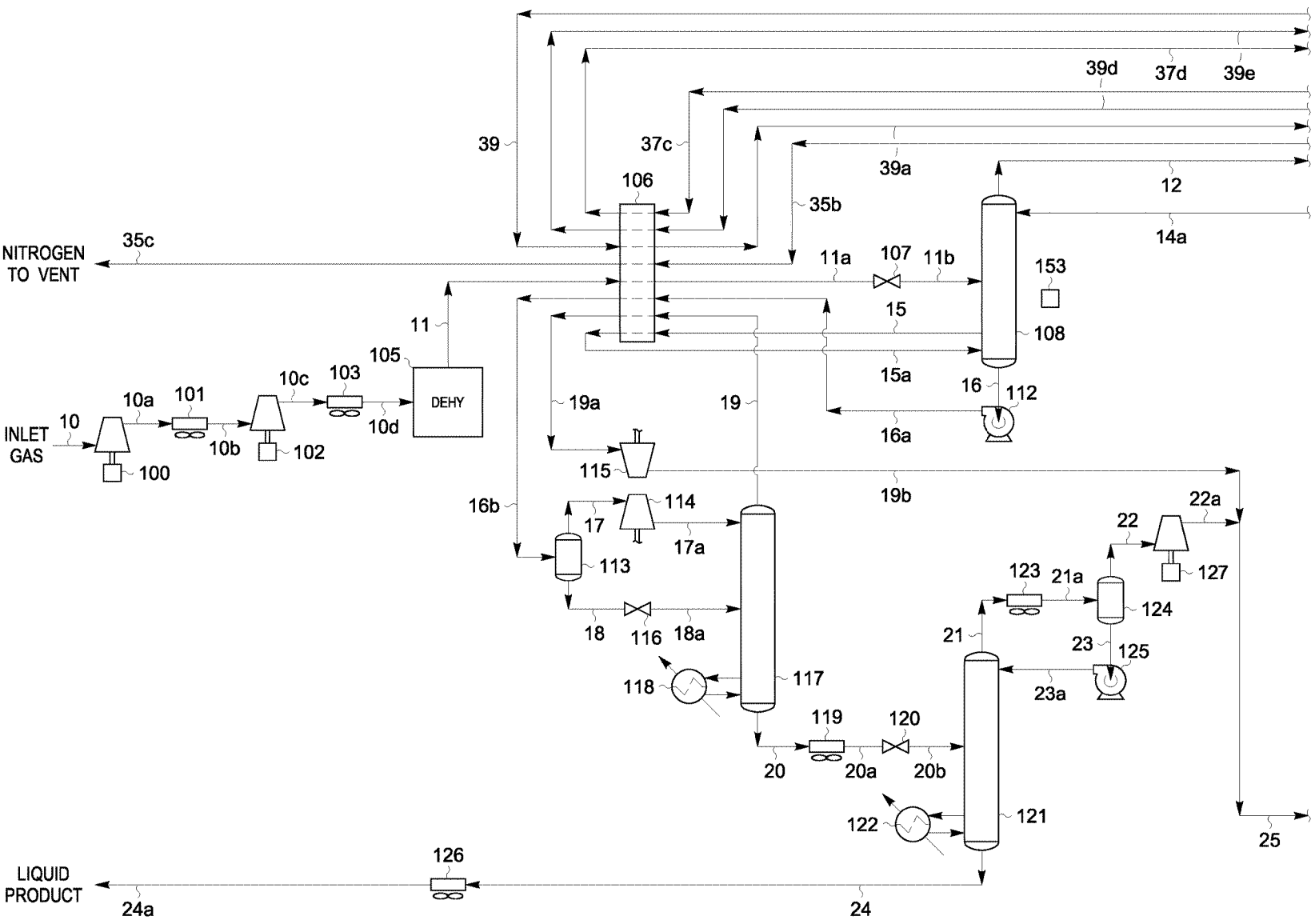
Figure 6B:
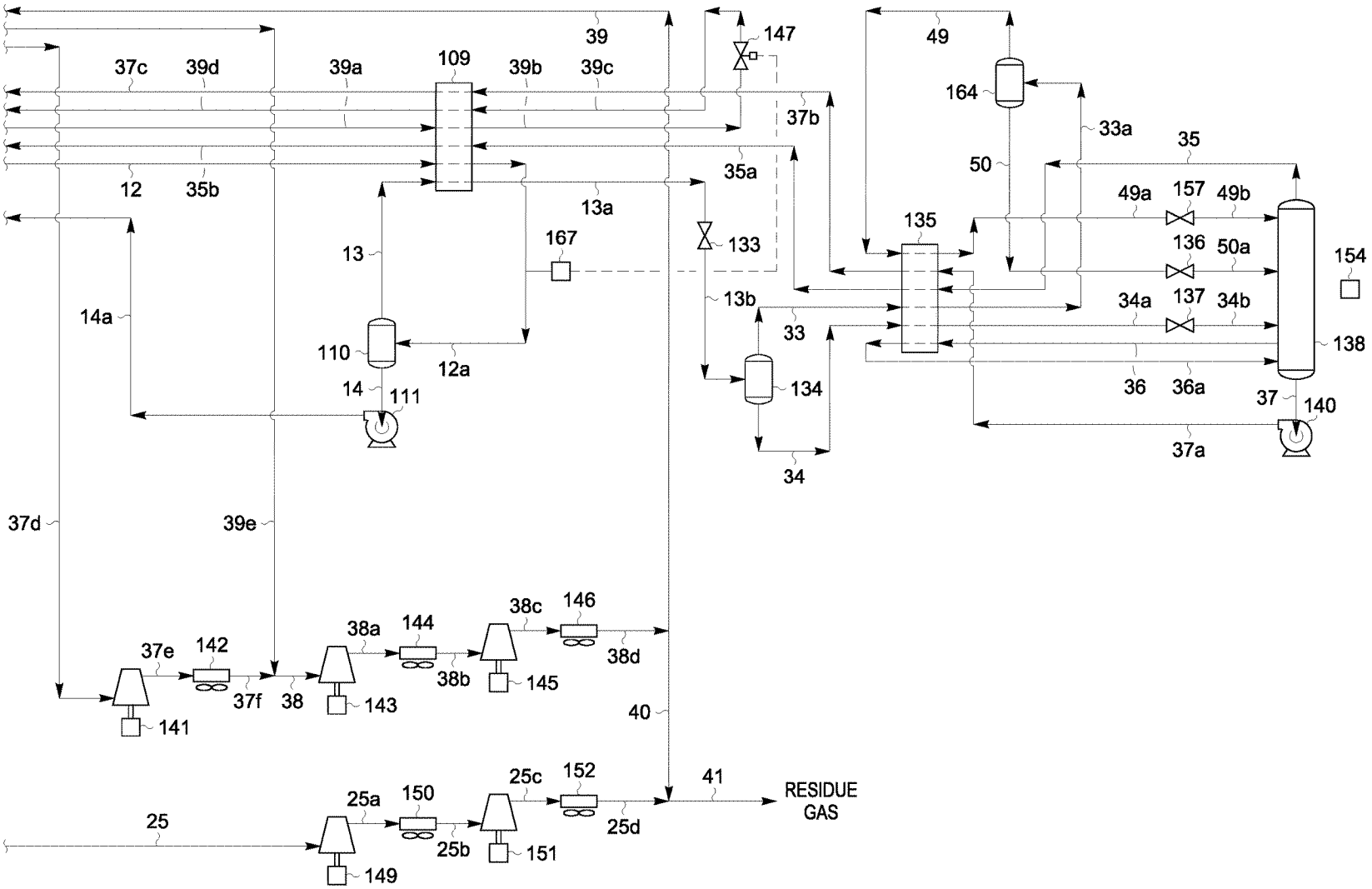

Another method for reducing the methane concentration in the nitrogen vent below that of the FIGS. 2*a*/2*b* embodiment of the present invention is the embodiment shown in FIGS. 6*a*/6*b*. The processing of feed stream 10 in the FIGS. 6*a*/6*b* embodiment of the present invention occurs under much the same conditions as for the FIGS. 2*a*/2*b* embodiment. The key difference is the processing of vapor stream 33 from separator 134. Instead of being totally condensed in heat exchanger 135 as in the FIGS. 2*a*/2*b* embodiment, it is partially condensed (stream 33*a*) and then separated into its vapor and liquid phases (vapor stream 49 and liquid stream 50, respectively) in separator 164.

Liquid stream 50 is flash expanded to the operating pressure of nitrogen column 138 by expansion valve 136 (stream 50*a*) and supplied to the column at an upper mid-column feed position, above that of the mid-column feed position of flash expanded stream 34*b*. Vapor stream 49 contains less methane than vapor stream 33, so when it is cooled and condensed in heat exchanger 135 and flash expanded to the operating pressure of nitrogen column 138 by expansion valve 157 (stream 49*b*), it is supplied to the column at the top column feed position. Stream 49*b* then provides additional rectification so that the column overhead vapor (stream 35) contains very little methane. Stream 35 and the column bottom liquid (stream 37) are then processed much the same as before in the FIGS. 2*a*/2*b* embodiment of the present invention.

Figure 7A:
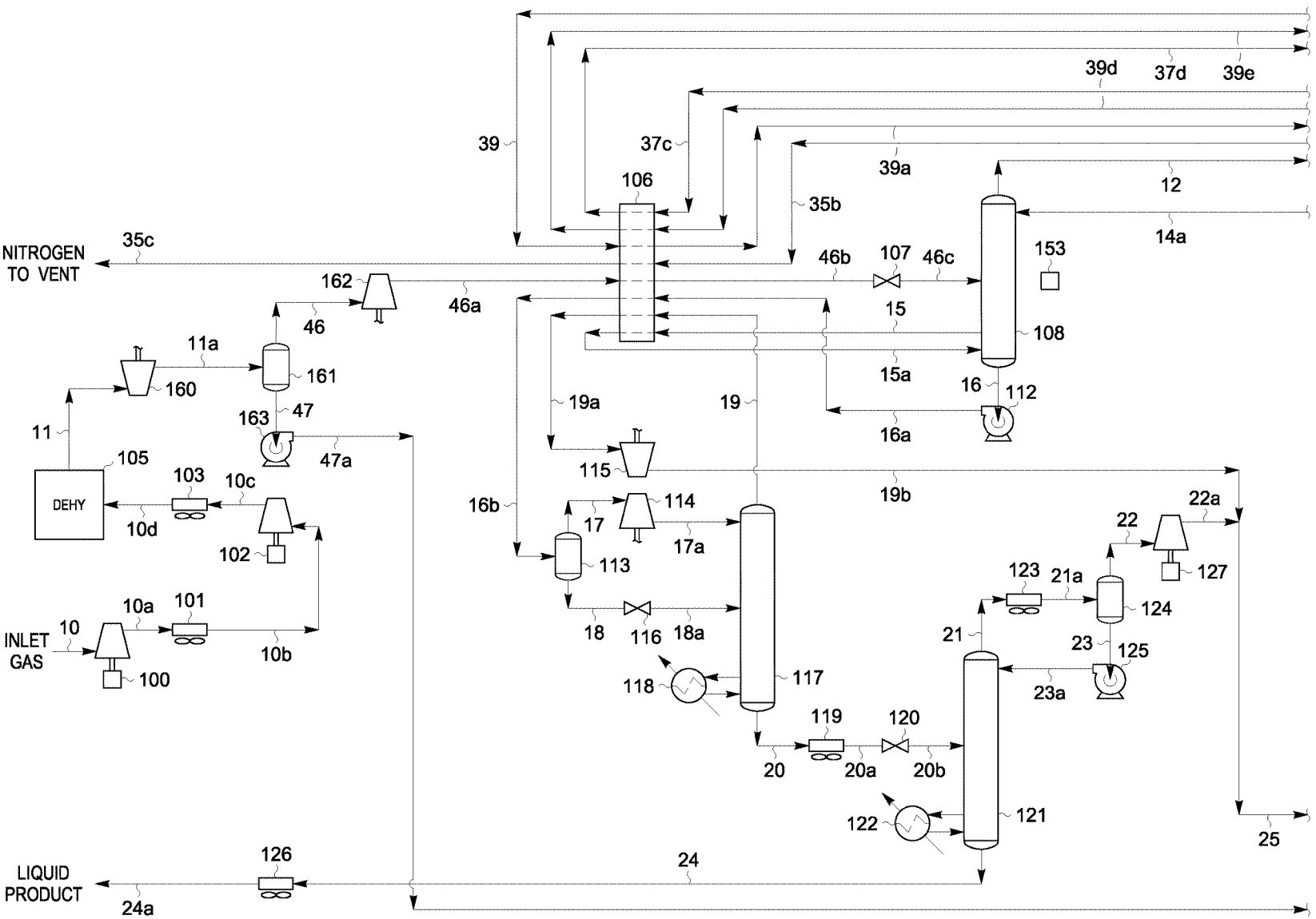
Figure 7B:
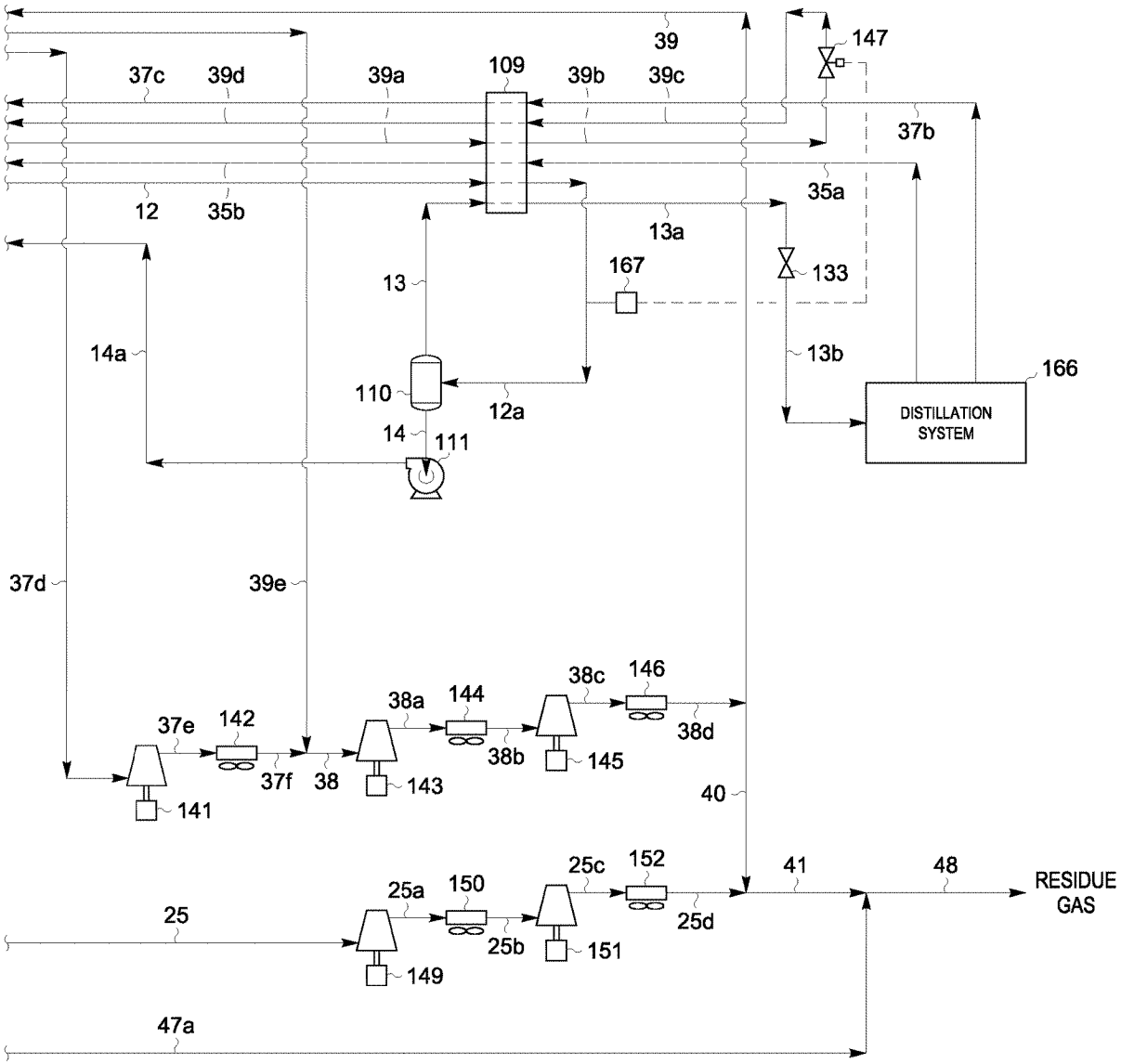

In some cases, the feed gas (stream 11) may contain high concentrations of aromatic hydrocarbons (benzene, toluene, ethylbenzene, and/or xylene, BTEX) and/or heavy n-paraffinic hydrocarbons as well as carbon dioxide. These hydrocarbon contaminants can freeze out of solution in the colder sections of the plant (like the distillation system used to separate nitrogen and methane shown in FIGS. 2*b*, 3*b*, 4*b*, 5*b*, and 6*b*) and disrupt processing. In such cases, the embodiments of the present invention shown in FIGS. 7*a*/7*b* and 8*a*/8*b* can be applied to remove these hydrocarbon contaminants upstream of hydrocarbon recovery column 108. These embodiments can be combined with any of the embodiments shown in FIGS. 2*b*, 3*b*, 4*b*, 5*b*, and 6*b* of the present invention. In the FIGS. 7*a*/7*b* embodiment, feed gas stream 11 is expanded to an intermediate pressure by an expansion device, such as work expansion machine 160, cooling stream 11*a* and condensing the heavier hydrocarbons. Separator 161 then separates the condensed liquid containing the majority of the hydrocarbon contaminants (stream 47) from the vapor (stream 46). Depending on the quantity and composition of liquid stream 47, it may be pumped to higher pressure by pump 163 (stream 47*a*) and mixed with stream 41 to form residue gas stream 48 or routed to the fractionation system (columns 117 and 121). Vapor stream 46 is compressed to higher pressure by compressor 162 (which may be driven by the work recovered in expansion machine 160) and stream 46*a* is then routed to heat exchanger 106 for processing in the same fashion as stream 11 is processed in FIGS. 2*a*/2*b*, 3*a*/3*b*, 4*a*/4*b*, 5*a*/5*b*, or 6*a*/6*b*.

Figure 8A:
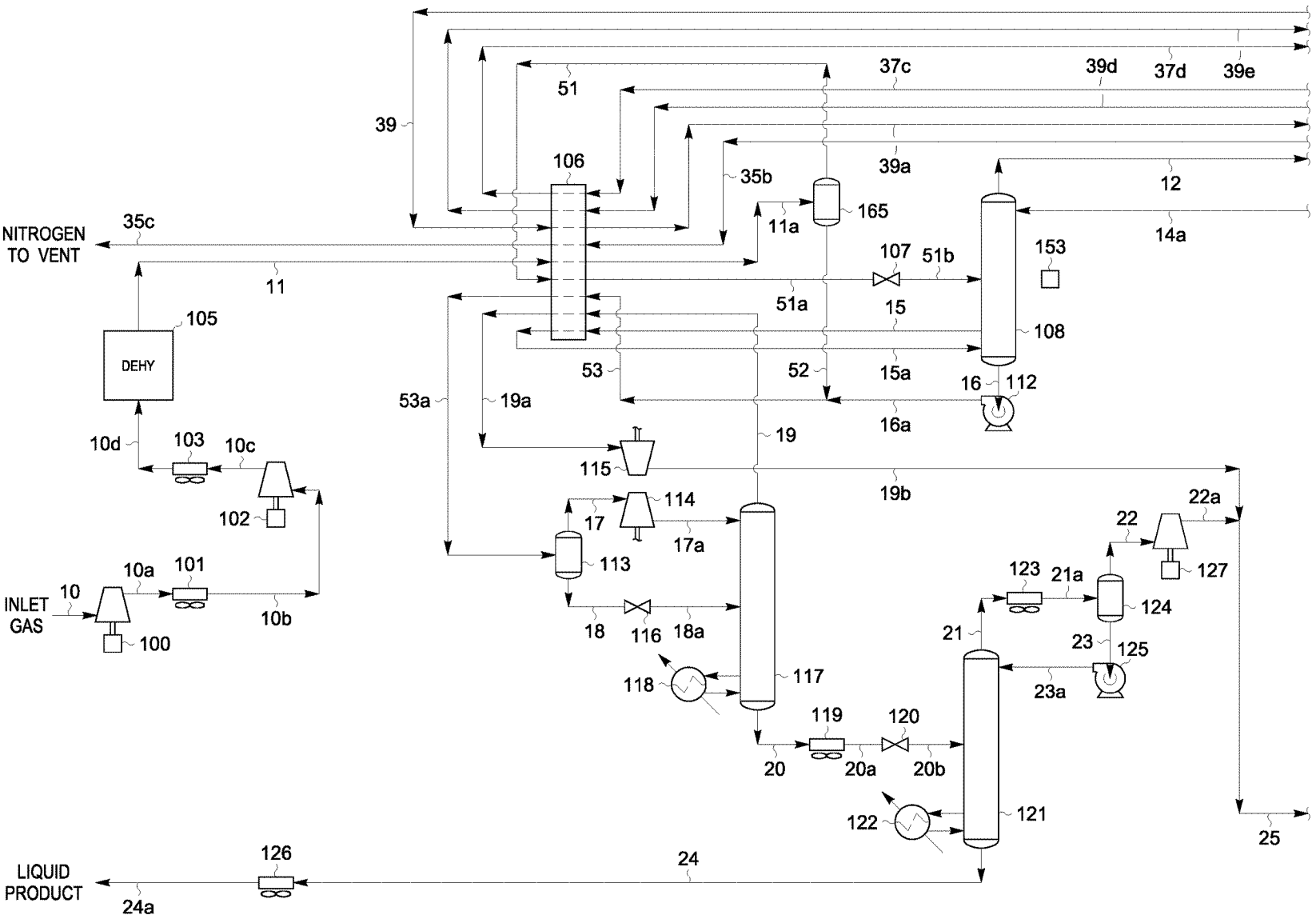
Figure 8B:
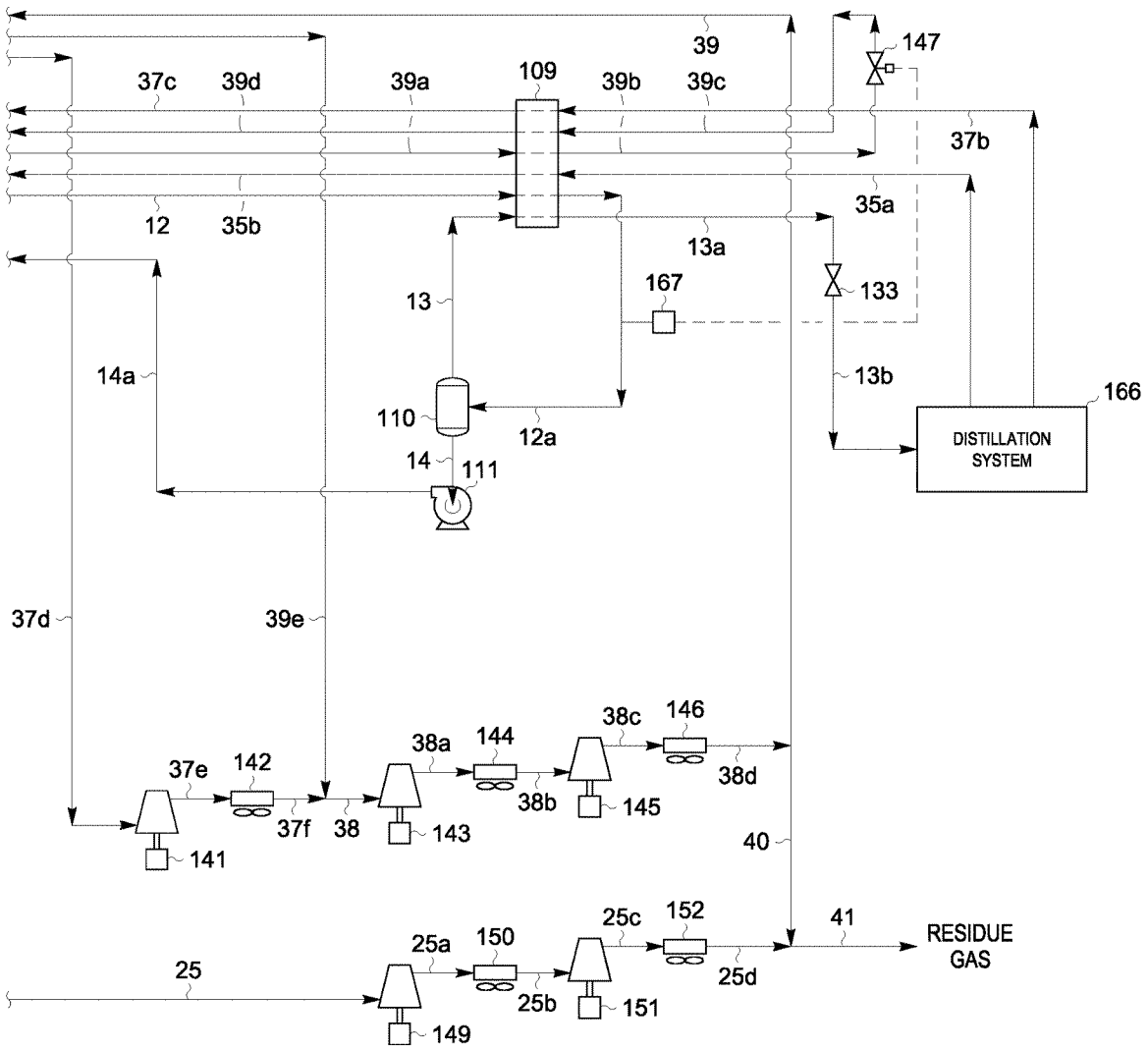

In the FIGS. 8*a*/8*b* embodiment, feed gas stream 11 is cooled and partially condensed in heat exchanger 106 (stream 11*a*) and then enters separator 165 to separate the vapor (stream 51) from the liquid (stream 52). Liquid stream 52 will contain the majority of the hydrocarbon contaminants and can be combined with liquid stream 16*a* from hydrocarbon recovery column 108 to form stream 53 that is routed to the fractionation system (columns 117 and 121). Vapor stream 51 is routed to heat exchanger 106 for processing in the same fashion as stream 11 is processed in FIGS. 2*a*/2*b*, 3*a*/3*b*, 4*a*/4*b*, 5*a*/5*b*, or 6*a*/6*b*.

In accordance with the present invention, the use of external refrigeration to supplement the cooling available to the inlet gas from other process streams may be employed, particularly in the case of a rich inlet gas. For instance, a mixed refrigerant closed loop cycle could be used in lieu of the open loop refrigerant cycle represented by stream 39 in FIGS. 2*a*/2*b*, 3*a*/3*b*, 4*a*/4*b*, 5*a*/5*b*, 6*a*/6*b*, 7*a*/7*b*, and 8*a*/8*b*. The use and distribution of side draw liquids for process heat exchange, and the particular arrangement of heat exchangers for the various cooling services must be evaluated for each particular application, as well as the choice of process streams for specific heat exchange services.

The present invention provides improved separation of nitrogen from a hydrocarbon gas stream with lower utility consumption required to operate the process. At the same degree of separation, an improvement may also be effected in still lower utility consumption required for operating the process, which may appear in the form of reduced power requirements for compression or re-compression, reduced power requirements for external refrigeration, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

SPECIFIC EMBODIMENTS

While the following is described in conjunction with specific embodiments, it will be understood that this description is intended to illustrate and not limit the scope of the preceding description and the appended claims.

A first embodiment of the invention is a process for the separation of a gas stream containing methane, heavier hydrocarbon components, and significant quantities of nitrogen and carbon dioxide into (i) a purge stream containing a major portion of the nitrogen, (ii) a volatile residue gas fraction containing a major portion of the methane, and (iii) a relatively less volatile fraction containing a portion of the heavier hydrocarbon components wherein the gas stream is cooled under pressure to form a cooled gas stream; the cooled gas stream is expanded to a first intermediate pressure to form an expanded cooled gas stream, whereupon the expanded cooled gas stream is supplied to a first distillation column at a mid-column feed position; the expanded cooled gas stream is fractionated in the first distillation column at the first intermediate pressure to form a first overhead vapor stream comprising nitrogen and no more than 0.001 wt % carbon dioxide and a first hydrocarbon liquid stream containing a major portion of the carbon dioxide; the first hydrocarbon liquid stream is pumped and heated to form a heated first hydrocarbon liquid stream, thereby to supply at least a portion of the cooling of the first step; the heated first hydrocarbon liquid stream is supplied to a fractionation system to fractionate the heated first hydrocarbon liquid stream to form the relatively less volatile fraction containing a portion of the heavier hydrocarbon components and a first hydrocarbon vapor stream containing methane and the remaining portion of the heavier hydrocarbon components; the first overhead vapor stream is cooled sufficiently to form a partially condensed stream; the partially condensed stream and measuring a temperature of the partially condensed stream and comparing the temperature to a setpoint; the partially condensed stream is separated thereby to provide a first vapor stream and a first liquid stream, whereupon the first liquid stream is supplied to the first distillation column at a top feed position; the first vapor stream is cooled and then expanded to a lower pressure to form an expanded cooled stream; the expanded cooled stream is supplied to a distillation system to distill the expanded cooled stream to form a heated vapor stream containing a major portion of the nitrogen and a heated second hydrocarbon liquid stream; the heated vapor stream is further heated to form the purge stream, thereby to supply at least a portion of the cooling; the heated second hydrocarbon liquid stream is further heated to vaporize the second hydrocarbon liquid stream to form a second hydrocarbon vapor stream, thereby to supply at least a portion of the cooling; the second hydrocarbon vapor stream is compressed to a first higher pressure and cooled to form a cooled compressed vapor stream; the cooled compressed vapor stream and the first hydrocarbon vapor stream are combined to form the volatile residue gas fraction; a refrigerant stream is cooled to form a cooled refrigerant stream, thereby to supply at least a portion of the heating; the cooled refrigerant stream is expanded to a second intermediate pressure to form an expanded cooled refrigerant stream and adjusting the second intermediate pressure based on the comparison of the temperature of the partially condensed stream to the setpoint; the expanded cooled refrigerant stream is heated to form a heated refrigerant stream, thereby to supply at least a portion of the cooling; the heated refrigerant stream is compressed to a second higher pressure and cooled to form the refrigerant stream; and the quantities and temperatures of the feed streams to the first distillation column are effective to maintain the overhead temperature of the first distillation column at a temperature whereby the major portion of the carbon dioxide is recovered in the first hydrocarbon liquid stream. An embodiment of the invention is one, any or all of prior embodiments in this paragraph up through the first embodiment in this paragraph wherein the expanded cooled stream is separated thereby to provide a second vapor stream and a second liquid stream; the second vapor stream is cooled and then expanded to a still lower pressure to form an expanded cooled vapor stream, whereupon the expanded cooled vapor stream is supplied to a second distillation column at a top feed position; the second liquid stream is cooled and then expanded to the still lower pressure to form an expanded cooled liquid stream, whereupon the expanded cooled liquid stream is supplied to the second distillation column at a mid-column feed position; the expanded cooled vapor stream and the expanded cooled liquid stream are fractionated in the second distillation column at the still lower pressure to form a second overhead vapor stream containing a major portion of the nitrogen and a second hydrocarbon liquid stream; the second overhead vapor stream is heated to form the heated vapor stream, thereby to supply at least a portion of the cooling of the second and third steps; the second hydrocarbon liquid stream is pumped and heated to form the heated second hydrocarbon liquid stream, thereby to supply at least a portion of the cooling of the second and third steps; and the quantities and temperatures of the feed streams to the second distillation column are effective to maintain the overhead temperature of the second distillation column at a temperature whereby the major portion of the methane is recovered in the second hydrocarbon liquid stream. An embodiment of the invention is one, any or all of prior embodiments in this paragraph up through the first embodiment in this paragraph wherein the expanded cooled stream is separated thereby to provide a second vapor stream and a second liquid stream; the second vapor stream is cooled and then expanded to a still lower pressure to form an expanded cooled vapor stream, whereupon the expanded cooled vapor stream is supplied to a second distillation column at a mid-column feed position; the second liquid stream is cooled and then expanded to the still lower pressure to form an expanded cooled liquid stream, whereupon the expanded cooled liquid stream is supplied to the second distillation column at a lower mid-column feed position below that of the mid-column feed position; the expanded cooled vapor stream and the expanded cooled liquid stream are fractionated in the second distillation column at the still lower pressure to form a second overhead vapor stream containing a major portion of the nitrogen and a second hydrocarbon liquid stream; the second hydrocarbon liquid stream is pumped and heated to form the heated second hydrocarbon liquid stream, thereby to supply at least a portion of the cooling of the second and third steps; the second overhead vapor stream is heated to form the heated vapor stream, thereby to supply at least a portion of the cooling of the second and third steps; the heated vapor stream is further heated to form a further heated vapor stream, thereby to supply at least a portion of the cooling; the further heated vapor stream is divided into a first portion and a second portion; the first portion is heated to form the purge stream, thereby to supply at least a portion of the cooling of the first step; the second portion is compressed to a third intermediate pressure to form a compressed second portion; the compressed second portion is cooled and condensed to form a condensed second portion; thereby to supply at least a portion of the heating steps; the condensed second portion is expanded to the still lower pressure to form an expanded second portion, whereupon the expanded second portion is supplied to the second distillation column at a top feed position; and the quantities and temperatures of the feed streams to the second distillation column are effective to maintain the overhead temperature of the second distillation column at a temperature whereby the major portion of the methane is recovered in the second hydrocarbon liquid stream. An embodiment of the invention is one, any or all of prior embodiments in this paragraph up through the first embodiment in this paragraph wherein the expanded cooled stream is separated thereby to provide a second vapor stream and a second liquid stream; the second vapor stream is cooled and then expanded to a still lower pressure to form an expanded cooled vapor stream, whereupon the expanded cooled vapor stream is supplied to a second distillation column at a mid-column feed position; the second liquid stream is cooled and then expanded to the still lower pressure to form an expanded cooled liquid stream, whereupon the expanded cooled liquid stream is supplied to the second distillation column at a lower mid-column feed position below that of the mid-column feed position; the expanded cooled vapor stream and the expanded cooled liquid stream are fractionated in the second distillation column at the still lower pressure to form a second overhead vapor stream containing a major portion of the nitrogen and a second hydrocarbon liquid stream; the second hydrocarbon liquid stream is pumped and heated to form the heated second hydrocarbon liquid stream, thereby to supply at least a portion of the cooling of steps (b) and (c); the second overhead vapor stream is divided into a first portion and a second portion; the first portion is heated to form the heated vapor stream, thereby to supply at least a portion of the cooling of steps (b) and (c); the second portion is compressed to a third intermediate pressure to form a compressed second portion; the compressed second portion is cooled and condensed to form a condensed second portion; thereby to supply at least a portion of the heating of steps (e) and (g); the condensed second portion is expanded to the still lower pressure to form an expanded second portion, whereupon the expanded second portion is supplied to the second distillation column at a top feed position; and the quantities and temperatures of the feed streams to the second distillation column are effective to maintain the overhead temperature of the second distillation column at a temperature whereby the major portion of the methane is recovered in the second hydrocarbon liquid stream. An embodiment of the invention is one, any or all of prior embodiments in this paragraph up through the first embodiment in this paragraph wherein the expanded cooled stream is supplied at a bottom feed position to an absorber column that produces a second vapor stream and a second liquid stream; the second vapor stream is cooled and condensed to form a condensed stream; the condensed stream is divided into a first reflux stream and a second reflux stream, whereupon the first reflux stream is supplied to the absorber column at a top feed position; the second reflux stream is cooled and then expanded to a still lower pressure to form an expanded cooled second reflux stream, whereupon the expanded cooled second reflux stream is supplied to a second distillation column at a top feed position; the second liquid stream is cooled and then expanded to the still lower pressure to form an expanded cooled liquid stream, whereupon the expanded cooled liquid stream is supplied to the second distillation column at a mid-column feed position; the expanded cooled second reflux stream and the expanded cooled liquid stream are fractionated in the second distillation column at the still lower pressure to form a second overhead vapor stream containing a major portion of the nitrogen and a second hydrocarbon liquid stream; the second overhead vapor stream is heated to form the heated vapor stream, thereby to supply at least a portion of the cooling of steps (b), (d), and (e); the second hydrocarbon liquid stream is pumped and heated to form the heated second hydrocarbon liquid stream, thereby to supply at least a portion of the cooling of steps (b), (d), and (e); and the quantities and temperatures of the feed streams to the second distillation column are effective to maintain the overhead temperature of the second distillation column at a temperature whereby the major portion of the methane is recovered in the second hydrocarbon liquid stream. An embodiment of the invention is one, any or all of prior embodiments in this paragraph up through the first embodiment in this paragraph wherein the expanded cooled stream is supplied at a bottom feed position to an absorber column that produces a second vapor stream and a second liquid stream; the second vapor stream is cooled to form a cooled stream, with the cooling sufficient to partially condense the cooled stream; the cooled stream is separated to provide a third vapor stream and a third liquid stream; the third vapor stream is cooled and condensed, then expanded to a still lower pressure to form an expanded condensed stream, whereupon the expanded condensed stream is supplied to a second distillation column at a top feed position; the third liquid stream is expanded to the still lower pressure to form an expanded liquid stream, whereupon the expanded liquid stream is supplied to the second distillation column at a mid-column feed position; the second liquid stream is cooled and then expanded to the still lower pressure to form an expanded cooled liquid stream, whereupon the expanded cooled liquid stream is supplied to the second distillation column at a lower mid-column feed position below that of the mid-column feed position; the expanded cooled vapor stream, the expanded liquid stream, and the expanded cooled liquid stream are fractionated in the second distillation column at the still lower pressure to form a second overhead vapor stream containing a major portion of the nitrogen and a second hydrocarbon liquid stream; the second hydrocarbon liquid stream is pumped and heated to form the heated second hydrocarbon liquid stream, thereby to supply at least a portion of the cooling of steps (b), (d), and (f); the second overhead vapor stream is heated to form the heated vapor stream, thereby to supply at least a portion of the cooling of steps (b), (d), and (f); and the quantities and temperatures of the feed streams to the second distillation column are effective to maintain the overhead temperature of the second distillation column at a temperature whereby the major portion of the methane is recovered in the second hydrocarbon liquid stream. An embodiment of the invention is one, any or all of prior embodiments in this paragraph up through the first embodiment in this paragraph, 2, 5, or 6 wherein the gas stream is expanded to a third intermediate pressure to form an expanded gas stream; the expanded gas stream is separated to produce a light vapor stream and a heavy liquid stream; the heavy liquid stream is combined with the cooled compressed vapor stream and the first hydrocarbon vapor stream to form the volatile residue gas fraction; and the light vapor stream is compressed to a third higher pressure and cooled under pressure to form the cooled gas stream. An embodiment of the invention is one, any or all of prior embodiments in this paragraph up through the first embodiment in this paragraph or 4 wherein the gas stream is expanded to a fourth intermediate pressure to form an expanded gas stream; the expanded gas stream is separated to produce a light vapor stream and a heavy liquid stream; the heavy liquid stream is combined with the cooled compressed vapor stream and the first hydrocarbon vapor stream to form the volatile residue gas fraction; and the light vapor stream is compressed to a third higher pressure and cooled under pressure to form the cooled gas stream. An embodiment of the invention is one, any or all of prior embodiments in this paragraph up through the first embodiment in this paragraph, wherein the gas stream is cooled under pressure to form a partially cooled gas stream; the partially cooled gas stream is separated to produce a light vapor stream and a heavy liquid stream; the light vapor stream is further cooled under pressure to form the cooled gas stream; the heavy liquid stream is combined with the pumped first hydrocarbon liquid stream to form a combined liquid stream; the combined liquid stream is heated to form a heated combined liquid stream, thereby to supply at least a portion of the cooling of step (c); and the heated combined liquid stream is supplied to the fractionation system. An embodiment of the invention is one, any or all of prior embodiments in this paragraph up through the first embodiment in this paragraph, wherein the cooled compressed vapor stream is combined with the heated refrigerant stream to form a combined stream; the combined stream is compressed to the second higher pressure and cooled to form a cooled compressed combined stream; the cooled compressed combined stream is divided into a third hydrocarbon vapor stream and the refrigerant stream; and the third hydrocarbon vapor stream and the first hydrocarbon vapor stream are combined to form the volatile residue gas fraction. An embodiment of the invention is one, any or all of prior embodiments in this paragraph up through the first embodiment in this paragraph wherein the cooled compressed vapor stream is combined with the heated refrigerant stream to form a combined stream; the combined stream is compressed to the second higher pressure and cooled to form a cooled compressed combined stream; the cooled compressed combined stream is divided into a third hydrocarbon vapor stream and the refrigerant stream; and the third hydrocarbon vapor stream, the first hydrocarbon vapor stream, and the heavy liquid stream are combined to form the volatile residue gas fraction. An embodiment of the invention is one, any or all of prior embodiments in this paragraph up through the first embodiment in this paragraph wherein the cooled compressed vapor stream is combined with the heated refrigerant stream to form a combined stream; the combined stream is compressed to the second higher pressure and cooled to form a cooled compressed combined stream; the cooled compressed combined stream is divided into a third hydrocarbon vapor stream and the refrigerant stream; and the third hydrocarbon vapor stream, the first hydrocarbon vapor stream, and the heavy liquid stream are combined to form the volatile residue gas fraction. An embodiment of the invention is one, any or all of prior embodiments in this paragraph up through the first embodiment in this paragraph wherein the cooled compressed vapor stream is combined with the heated refrigerant stream to form a combined stream; the combined stream is compressed to the second higher pressure and cooled to form a cooled compressed combined stream; the cooled compressed combined stream is divided into a third hydrocarbon vapor stream and the refrigerant stream; and the third hydrocarbon vapor stream and the first hydrocarbon vapor stream are combined to form the volatile residue gas fraction.

A second embodiment of the invention is an apparatus for the separation of a gas stream containing methane, heavier hydrocarbon components, and significant quantities of nitrogen and carbon dioxide into (i) a purge stream containing a major portion of the nitrogen, (ii) a volatile residue gas fraction containing a major portion of the methane, and (iii) a relatively less volatile fraction containing a portion of the heavier hydrocarbon components comprising first heat exchange means connected to receive the gas stream and cool the gas stream under pressure to form a cooled gas stream; first expansion means connected to the first heat exchange means to receive the cooled gas stream and expand the cooled gas stream to a first intermediate pressure to form an expanded cooled gas stream; a first distillation column connected to the first expansion means to receive the expanded cooled gas stream at a mid-column feed position; the first distillation column adapted to fractionate the expanded cooled gas stream at the first intermediate pressure to form a first overhead vapor stream comprising nitrogen and no more than 0.001 wt. % carbon dioxide and a first hydrocarbon liquid stream containing a major portion of the carbon dioxide; first pumping means connected to the first distillation column to receive the first hydrocarbon liquid stream and pump the first hydrocarbon liquid stream to form a pumped first hydrocarbon liquid stream; the first heat exchange means further connected to the first pumping means to receive the pumped first hydrocarbon liquid stream and heat the pumped first hydrocarbon liquid stream to form a heated first hydrocarbon liquid stream, thereby to supply at least a portion of the cooling of the first step; fractionation means connected to the first heat exchange means to receive the heated first hydrocarbon liquid stream and fractionate the heated first hydrocarbon liquid stream to form the relatively less volatile fraction containing a portion of the heavier hydrocarbon components and a first hydrocarbon vapor stream containing methane and the remaining portion of the heavier hydrocarbon components; second heat exchange means connected to the first distillation column to receive the first overhead vapor stream and cool the first overhead vapor stream sufficiently to form a partially condensed stream wherein a device includes a sensor for measuring a temperature of the partially condensed stream and the device is configured to compare the temperature to a setpoint; first separating means connected to the second heat exchange means to receive the partially condensed stream and separate the partially condensed stream into a first vapor stream and a first liquid stream, the first separating means being further connected to the first distillation column to supply the first liquid stream to the first distillation column at a top feed position; the second heat exchange means further connected to the first separating means to receive the first vapor stream and cool the first vapor stream to form a cooled first vapor stream; second expansion means connected to the second heat exchange means to receive the cooled first vapor stream and expand the cooled first vapor stream to a lower pressure to form an expanded cooled stream; distillation means connected to the second expansion means to receive the expanded cooled stream to distill the expanded cooled stream to form a heated vapor stream containing a major portion of the nitrogen and a heated second hydrocarbon liquid stream; the second heat exchange means further connected to the distillation means and the first exchange means further connected to the second heat exchange means to receive the heated vapor stream and further heat the heated vapor stream to form the purge stream, thereby to supply at least a portion of the cooling of steps; the second heat exchange means further connected to the distillation means and the first exchange means further connected to the second heat exchange means to receive the heated second hydrocarbon liquid stream and further heat and vaporize the heated second hydrocarbon liquid stream to form a second hydrocarbon vapor stream, thereby to supply at least a portion of the cooling of steps (1), (8), and (10); first compressing and cooling means connected to the first heat exchange means to receive the second hydrocarbon vapor stream and compress to a first higher pressure and cool the second hydrocarbon vapor stream to form a cooled compressed vapor stream; combining means connected to the first compressing and cooling means and to the fractionation means to receive the cooled compressed vapor stream and the first hydrocarbon vapor stream and combine the cooled compressed vapor stream and the first hydrocarbon vapor stream to form the volatile residue gas fraction; the first heat exchange means further connected to receive a refrigerant stream and further connected to the second heat exchange means to cool the refrigerant stream to form a cooled refrigerant stream, thereby to supply at least a portion of the heating steps; third expansion means connected to the second heat exchange means to receive the cooled refrigerant stream and expand the cooled refrigerant stream to a second intermediate pressure to form an expanded cooled refrigerant stream wherein an expansion valve adjusts said second intermediate pressure based on the comparison of the temperature of the partially condensed stream to the setpoint; the second heat exchange means further connected to the third expansion means and the first heat exchange means further connected to the second heat exchange means to receive the expanded cooled refrigerant stream and heat the expanded cooled refrigerant stream to form a heated refrigerant stream, thereby to supply at least a portion of the cooling of steps; second compressing and cooling means connected to the first heat exchange means to receive the heated refrigerant stream and compress to a second higher pressure and cool the heated refrigerant stream to form the refrigerant stream, the second compressing and cooling means being further connected to the first heat exchange means to supply the refrigerant stream thereto; and first control means adapted to regulate the quantities and temperatures of the expanded cooled gas stream and the first liquid stream to the first distillation column to maintain the overhead temperature of the first distillation column at a temperature whereby the major portion of the carbon dioxide is recovered in the first hydrocarbon liquid stream. An embodiment of the invention is one, any or all of prior embodiments in this paragraph up through the second embodiment in this paragraph wherein the distillation means is comprised of second separating means connected to the second expansion means to receive the expanded cooled stream and separate the expanded cooled stream into a second vapor stream and a second liquid stream; third heat exchange means connected to the second separating means to receive the second vapor stream and cool the second vapor stream to form a cooled vapor stream; fourth expansion means connected to the third heat exchange means to receive the cooled vapor stream and expand the cooled vapor stream to a still lower pressure to form an expanded cooled vapor stream; second distillation column connected to the fourth expansion means to receive the expanded cooled vapor stream at a top feed position; the third heat exchange means further connected to the second separating means to receive the second liquid stream and cool the second liquid stream to form a cooled liquid stream; fifth expansion means connected to the third heat exchange means to receive the cooled liquid stream and expand the cooled liquid stream to the still lower pressure to form an expanded cooled liquid stream, the fifth expansion means being further connected to the second distillation column to supply the expanded cooled liquid stream to the second distillation column at a mid-column feed position; the second distillation column adapted to fractionate the expanded cooled vapor stream and the expanded cooled liquid stream at the still lower pressure to form a second overhead vapor stream containing a major portion of the nitrogen and a second hydrocarbon liquid stream; the third heat exchange means further connected to the second distillation column to receive the second overhead vapor stream and heat the second overhead vapor stream to form the heated vapor stream, thereby to supply at least a portion of the cooling of steps (b) and (e); second pumping means connected to the second distillation column to receive the second hydrocarbon liquid stream and pump the second hydrocarbon liquid stream to form a pumped second hydrocarbon liquid stream; the third heat exchange means further connected to the second pumping means to receive the pumped second hydrocarbon liquid stream and heat the pumped second hydrocarbon liquid stream to form the heated second hydrocarbon vapor stream, thereby to supply at least a portion of the cooling of steps (b) and (e); and second control means adapted to regulate the quantities and temperatures of the expanded cooled vapor stream and the expanded cooled liquid stream to the second distillation column to maintain the overhead temperature of the second distillation column at a temperature whereby the major portion of the methane is recovered in the second hydrocarbon liquid stream. An embodiment of the invention is one, any or all of prior embodiments in this paragraph up through the second embodiment in this paragraph wherein the distillation means is comprised of second separating means connected to the second expansion means to receive the expanded cooled stream and separate the expanded cooled stream into a second vapor stream and a second liquid stream; third heat exchange means connected to the second separating means to receive the second vapor stream and cool the second vapor stream to form a cooled vapor stream; fourth expansion means connected to the third heat exchange means to receive the cooled vapor stream and expand the cooled vapor stream to a still lower pressure to form an expanded cooled vapor stream; second distillation column connected to the fourth expansion means to receive the expanded cooled vapor stream at a mid-column feed position; the third heat exchange means further connected to the second separating means to receive the second liquid stream and cool the second liquid stream to form a cooled liquid stream; fifth expansion means connected to the third heat exchange means to receive the cooled liquid stream and expand the cooled liquid stream to the still lower pressure to form an expanded cooled liquid stream, the fifth expansion means being further connected to the second distillation column to supply the expanded cooled liquid stream to the second distillation column at a lower mid-column feed position below the mid-column feed position; the second distillation column adapted to fractionate the expanded cooled vapor stream and the expanded cooled liquid stream at the still lower pressure to form a second overhead vapor stream containing a major portion of the nitrogen and a second hydrocarbon liquid stream; the third heat exchange means further connected to the second distillation column to receive the second overhead vapor stream and heat the second overhead vapor stream to form the heated vapor stream, thereby to supply at least a portion of the cooling of steps (b) and (e); second pumping means connected to the second distillation column to receive the second hydrocarbon liquid stream and pump the second hydrocarbon liquid stream to form a pumped second hydrocarbon liquid stream; and the third heat exchange means further connected to the second pumping means to receive the pumped second hydrocarbon liquid stream and heat the pumped second hydrocarbon liquid stream to form the heated second hydrocarbon vapor stream, thereby to supply at least a portion of the cooling of steps (b) and (e); and the adaptation of the apparatus is such that the second heat exchange means is adapted to further heat the heated vapor stream to form a further heated vapor stream, thereby to supply at least a portion of the cooling of steps (8) and (10); a dividing means is connected to the second heat exchange means to receive the further heated vapor stream and divide the further heated vapor stream into a first portion and a second portion; the first heat exchange means is adapted to receive the first portion and heat the first portion to form the purge stream, thereby to supply at least a portion of the cooling of step (1); a third compressing and cooling means is connected to the dividing means to receive the second portion and compress second portion to a third intermediate pressure to form a compressed second portion; and the first heat exchange means is further connected to the third compressing and cooling means to receive the compressed second portion and further connected to cool the compressed second portion to form a cooled second portion, thereby to supply at least a portion of the heating of steps (13) and (14); and the distillation means is further comprised of the third heat exchange means further connected to the second heat exchange means to receive the cooled second portion and further cool and condense the cooled second portion to form a condensed second portion, thereby to provide at least a portion of the heating of steps (h) and (j); and sixth expansion means connected to the third heat exchange means to receive the condensed second portion and expand the condensed second portion to the still lower pressure to form an expanded second portion, the sixth expansion means being further connected to the second distillation column to supply the expanded second portion to the second distillation column at a top feed position; and second control means adapted to regulate the quantities and temperatures of the expanded second portion, the expanded cooled vapor stream, and the expanded cooled liquid stream to the second distillation column to maintain the overhead temperature of the second distillation column at a temperature whereby the major portion of the methane is recovered in the second hydrocarbon liquid stream. An embodiment of the invention is one, any or all of prior embodiments in this paragraph up through the second embodiment in this paragraph wherein the distillation means is comprised of second separating means connected to the second expansion means to receive the expanded cooled stream and separate the expanded cooled stream into a second vapor stream and a second liquid stream; third heat exchange means connected to the second separating means to receive the second vapor stream and cool the second vapor stream to form a cooled vapor stream; fourth expansion means connected to the third heat exchange means to receive the cooled vapor stream and expand the cooled vapor stream to a still lower pressure to form an expanded cooled vapor stream; second distillation column connected to the fourth expansion means to receive the expanded cooled vapor stream at a mid-column feed position; the third heat exchange means further connected to the second separating means to receive the second liquid stream and cool the second liquid stream to form a cooled liquid stream; fifth expansion means connected to the third heat exchange means to receive the cooled liquid stream and expand the cooled liquid stream to the still lower pressure to form an expanded cooled liquid stream, the fifth expansion means being further connected to the second distillation column to supply the expanded cooled liquid stream to the second distillation column at a lower mid-column feed position below the mid-column feed position; the second distillation column adapted to fractionate the expanded cooled vapor stream and the expanded cooled liquid stream at the still lower pressure to form a second overhead vapor stream containing a major portion of the nitrogen and a second hydrocarbon liquid stream; second pumping means connected to the second distillation column to receive the second hydrocarbon liquid stream and pump the second hydrocarbon liquid stream to form a pumped second hydrocarbon liquid stream; the third heat exchange means further connected to the second pumping means to receive the pumped second hydrocarbon liquid stream and heat the pumped second hydrocarbon liquid stream to form the heated second hydrocarbon vapor stream, thereby to supply at least a portion of the cooling of steps (b) and (e); dividing means connected to the second distillation column to receive the second overhead vapor stream and divide the second overhead vapor stream into a first portion and a second portion; the third heat exchange means further connected to the dividing means to receive the first portion and heat the first portion to form the heated vapor stream, thereby to supply at least a portion of the cooling of steps (b) and (e); compressing means connected to the dividing means to receive the second portion and compress the second portion to a third intermediate pressure to form a compressed second portion; the third heat exchange means further connected to the compressing means to receive the compressed second portion and cool and condense the second portion to form a condensed second portion; sixth expansion means connected to the third heat exchange means to receive the condensed second portion and expand the condensed second portion to the still lower pressure to form an expanded second portion, the sixth expansion means being further connected to the second distillation column to supply the expanded second portion to the second distillation column at a top feed position; and second control means adapted to regulate the quantities and temperatures of the expanded second portion, the expanded cooled vapor stream, and the expanded cooled liquid stream to the second distillation column to maintain the overhead temperature of the second distillation column at a temperature whereby the major portion of the methane is recovered in the second hydrocarbon liquid stream. An embodiment of the invention is one, any or all of prior embodiments in this paragraph up through the second embodiment in this paragraph wherein the distillation means is comprised of absorption column connected to the second expansion means to receive the expanded cooled stream at a bottom feed position and produce a second vapor stream and a second liquid stream; third heat exchange means connected to the absorption column to receive the second vapor stream and cool and condense the second vapor stream to form a condensed stream; dividing means connected to the third heat exchange means to receive the condensed stream and divide the condensed stream into a first reflux stream and a second reflux stream; the absorption column further connected to the dividing means to receive the first reflux stream at a top feed position; third heat exchange means further connected to the dividing means to receive the second reflux stream and cool the second reflux stream to form a cooled second reflux stream; fourth expansion means connected to the third heat exchange means to receive the cooled second reflux stream and expand the cooled second reflux stream to a still lower pressure to form an expanded cooled second reflux stream; second distillation column connected to the fourth expansion means to receive the expanded cooled second reflux stream at a top feed position; the third heat exchange means further connected to the absorption column to receive the second liquid stream and cool the second liquid stream to form a cooled liquid stream; fifth expansion means connected to the third heat exchange means to receive the cooled liquid stream and expand the cooled liquid stream to the still lower pressure to form an expanded cooled liquid stream, the fifth expansion means being further connected to the second distillation column to supply the expanded cooled liquid stream to the second distillation column at a mid-column feed position; the second distillation column adapted to fractionate the expanded cooled second reflux stream and the expanded cooled liquid stream at the still lower pressure to form a second overhead vapor stream containing a major portion of the nitrogen and a second hydrocarbon liquid stream; the third heat exchange means further connected to the second distillation column to receive the second overhead vapor stream and heat the second overhead vapor stream to form the heated vapor stream, thereby to supply at least a portion of the cooling of steps (b), (e), and (h); second pumping means connected to the second distillation column to receive the second hydrocarbon liquid stream and pump the second hydrocarbon liquid stream to form a pumped second hydrocarbon liquid stream; the third heat exchange means further connected to the second pumping means to receive the pumped second hydrocarbon liquid stream and heat the pumped second hydrocarbon liquid stream to form the heated second hydrocarbon vapor stream, thereby to supply at least a portion of the cooling of steps (b), (e), and (h); and second control means adapted to regulate the quantities and temperatures of the expanded cooled second reflux stream and the expanded cooled liquid stream to the second distillation column to maintain the overhead temperature of the second distillation column at a temperature whereby the major portion of the methane is recovered in the second hydrocarbon liquid stream. An embodiment of the invention is one, any or all of prior embodiments in this paragraph up through the second embodiment in this paragraph wherein the distillation means is comprised of second separating means connected to the second expansion means to receive the expanded cooled stream and separate the expanded cooled stream into a second vapor stream and a second liquid stream; third heat exchange means connected to the second separating means to receive the second vapor stream and cool and partially condense the second vapor stream to form a cooled stream; third separating means connected to the third heat exchange means to receive the cooled stream and separate the cooled stream into a third vapor stream and a third liquid stream; fourth expansion means connected to the third separating means to receive the third liquid stream and expand the third liquid stream to a still lower pressure to form an expanded liquid stream; second distillation column connected to the fourth expansion means to receive the expanded liquid stream at a mid-column feed position; the third heat exchange means further connected to the second separating means to receive the second liquid stream and cool the second liquid stream to form a cooled liquid stream; fifth expansion means connected to the third heat exchange means to receive the cooled liquid stream and expand the cooled liquid stream to the still lower pressure to form an expanded cooled liquid stream, the fifth expansion means being further connected to the second distillation column to supply the expanded cooled liquid stream to the second distillation column at a lower mid-column feed position below the mid-column feed position; third heat exchange means further connected to the third separating means to receive the third vapor stream and cool and condense the third vapor stream to form a condensed stream; sixth expansion means connected to the third heat exchange means to receive the condensed stream and expand the condensed stream to the still lower pressure to form an expanded condensed stream, the sixth expansion means being further connected to the second distillation column to supply the expanded condensed stream to the second distillation column at a top feed position; the second distillation column adapted to fractionate the expanded condensed stream, the expanded liquid stream, and the expanded cooled liquid stream at the still lower pressure to form a second overhead vapor stream containing a major portion of the nitrogen and a second hydrocarbon liquid stream; second pumping means connected to the second distillation column to receive the second hydrocarbon liquid stream and pump the second hydrocarbon liquid stream to form a pumped second hydrocarbon liquid stream; the third heat exchange means further connected to the second pumping means to receive the pumped second hydrocarbon liquid stream and heat the pumped second hydrocarbon liquid stream to form the heated second hydrocarbon vapor stream, thereby to supply at least a portion of the cooling of steps (b), (f), and (h); the third heat exchange means further connected to the second distillation column to receive the second overhead vapor stream and heat the second overhead vapor stream to form the heated vapor stream, thereby to supply at least a portion of the cooling of steps (b), (f), and (h); and second control means adapted to regulate the quantities and temperatures of the expanded condensed stream, the expanded liquid stream, and the expanded cooled liquid stream to the second distillation column to maintain the overhead temperature of the second distillation column at a temperature whereby the major portion of the methane is recovered in the second hydrocarbon liquid stream. An embodiment of the invention is one, any or all of prior embodiments in this paragraph up through the second embodiment in this paragraph, wherein an additional expansion means is connected to receive the gas stream and expand the gas stream to a third intermediate pressure to form an expanded gas stream; an additional separation means is connected to the additional expansion means to receive the expanded gas stream and separate the expanded gas stream into a light vapor stream and a heavy liquid stream; the combining means is adapted to connect to the additional separation means to receive the heavy liquid stream and combine the heavy liquid stream with the cooled compressed vapor stream and the first hydrocarbon vapor stream to form volatile residue gas fraction; a vapor compressing means is connected to aid additional separation means to receive the light vapor stream and compress the light vapor stream to a third higher pressure to form a compressed vapor stream; and the first heat exchange means is adapted to connect to the vapor compressing means to receive the compressed vapor stream and cool the compressed vapor stream to form the cooled gas stream. An embodiment of the invention is one, any or all of prior embodiments in this paragraph up through the second embodiment in this paragraph wherein an additional expansion means is connected to receive the gas stream and expand the gas stream to a fourth intermediate pressure to form an expanded gas stream; an additional separation means is connected to the additional expansion means to receive the expanded gas stream and separate the expanded gas stream into a light vapor stream and a heavy liquid stream; the combining means is adapted to connect to the additional separation means to receive the heavy liquid stream and combine the heavy liquid stream with the cooled compressed vapor stream and the first hydrocarbon vapor stream to form volatile residue gas fraction; a vapor compressing means is connected to aid additional separation means to receive the light vapor stream and compress the light vapor stream to a third higher pressure to form a compressed vapor stream; and the first heat exchange means is adapted to connect to the vapor compressing means to receive the compressed vapor stream and cool the compressed vapor stream to form the cooled gas stream. An embodiment of the invention is one, any or all of prior embodiments in this paragraph up through the second embodiment in this paragraph, wherein the first heat exchange means is adapted to cool the gas stream sufficiently to partially condense the gas stream to form a partially cooled gas stream; an additional separation means is connected to the first heat exchange means to receive the partially cooled gas stream and separate the partially cooled gas stream into a light vapor stream and a heavy liquid stream; the first heat exchange means is further adapted to be connected to the additional separation means to receive the light vapor stream and cool the light vapor stream to form the cooled gas stream; an additional combining means is connected to the additional separation means and to the first pumping means to receive the heavy liquid stream and the pumped first hydrocarbon liquid stream and combine the heavy liquid stream and the pumped first hydrocarbon liquid stream to form a combined liquid stream; the first heat exchange means is further adapted to be connected to the additional combining means to receive the combined liquid stream and heat the combined liquid stream to form a heated combined liquid stream, thereby to supply at least a portion of the cooling of step (1); and the fractionation means is adapted to be connected to the first heat exchange means to receive the heated combined liquid stream and fractionate the heated combined liquid stream to form the relatively less volatile fraction containing a portion of the heavier hydrocarbon components and the first hydrocarbon vapor stream containing methane and the remaining portion of the heavier hydrocarbon components. An embodiment of the invention is one, any or all of prior embodiments in this paragraph up through the second embodiment in this paragraph, wherein a gas combining means is connected to the first compressing and cooling means and to the first heat exchange means to receive the cooled compressed vapor stream and the heated refrigerant stream and combine the cooled compressed vapor stream and the heated refrigerant stream to form a combined gas stream; the second compressing and cooling means is adapted to be connected to the gas combining means to receive the combined gas stream and compress to the second higher pressure and cool the combined gas stream to form a cooled compressed combined gas stream; a gas dividing means is connected to the second compressing and cooling means to receive the cooled compressed combined gas stream and divide the cooled compressed combined gas stream into a third hydrocarbon vapor stream and the refrigerant stream, the gas dividing means being further connected to the first heat exchange means to supply the refrigerant stream thereto; and the combining means is adapted to be connected to the gas dividing means to receive the third hydrocarbon vapor stream and combine the third hydrocarbon vapor stream and the first hydrocarbon vapor stream to form the volatile residue gas fraction. An embodiment of the invention is one, any or all of prior embodiments in this paragraph up through the second embodiment in this paragraph wherein a gas combining means is connected to the first compressing and cooling means and to the first heat exchange means to receive the cooled compressed vapor stream and the heated refrigerant stream and combine the cooled compressed vapor stream and the heated refrigerant stream to form a combined gas stream; the second compressing and cooling means is adapted to be connected to the gas combining means to receive the combined gas stream and compress to the second higher pressure and cool the combined gas stream to form a cooled compressed combined gas stream; a gas dividing means is connected to the second compressing and cooling means to receive the cooled compressed combined gas stream and divide the cooled compressed combined gas stream into a third hydrocarbon vapor stream and the refrigerant stream, the gas dividing means being further connected to the first heat exchange means to supply the refrigerant stream thereto; and the combining means is adapted to be connected to the gas dividing means to receive the third hydrocarbon vapor stream and combine the third hydrocarbon vapor stream, the first hydrocarbon vapor stream, and the heavy liquid stream to form the volatile residue gas fraction. An embodiment of the invention is one, any or all of prior embodiments in this paragraph up through the second embodiment in this paragraph wherein a gas combining means is connected to the first compressing and cooling means and to the first heat exchange means to receive the cooled compressed vapor stream and the heated refrigerant stream and combine the cooled compressed vapor stream and the heated refrigerant stream to form a combined gas stream; the second compressing and cooling means is adapted to be connected to the gas combining means to receive the combined gas stream and compress to the second higher pressure and cool the combined gas stream to form a cooled compressed combined gas stream; a gas dividing means is connected to the second compressing and cooling means to receive the cooled compressed combined gas stream and divide the cooled compressed combined gas stream into a third hydrocarbon vapor stream and the refrigerant stream, the gas dividing means being further connected to the first heat exchange means to supply the refrigerant stream thereto; and the combining means is adapted to be connected to the gas dividing means to receive the third hydrocarbon vapor stream and combine the third hydrocarbon vapor stream, the first hydrocarbon vapor stream, and the heavy liquid stream to form the volatile residue gas fraction. An embodiment of the invention is one, any or all of prior embodiments in this paragraph up through the second embodiment in this paragraph wherein a gas combining means is connected to the first compressing and cooling means and to the first heat exchange means to receive the cooled compressed vapor stream and the heated refrigerant stream and combine the cooled compressed vapor stream and the heated refrigerant stream to form a combined gas stream; the second compressing and cooling means is adapted to be connected to the gas combining means to receive the combined gas stream and compress to the second higher pressure and cool the combined gas stream to form a cooled compressed combined gas stream; a gas dividing means is connected to the second compressing and cooling means to receive the cooled compressed combined gas stream and divide the cooled compressed combined gas stream into a third hydrocarbon vapor stream and the refrigerant stream, the gas dividing means being further connected to the first heat exchange means to supply the refrigerant stream thereto; and the combining means is adapted to be connected to the gas dividing means to receive the third hydrocarbon vapor stream and combine the third hydrocarbon vapor stream and the first hydrocarbon vapor stream to form the volatile residue gas fraction.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

We claim:

1. A process for the separation of a gas stream containing methane, heavier hydrocarbon components, and significant quantities of nitrogen and carbon dioxide into (i) a purge stream containing a major portion of said nitrogen, (ii) a volatile residue gas fraction containing a major portion of said methane, and (iii) a relatively less volatile fraction containing a portion of said heavier hydrocarbon components wherein (1) said gas stream is cooled under pressure to form a cooled gas stream;

(2) said cooled gas stream is expanded to a first intermediate pressure to form an expanded cooled gas stream, whereupon said expanded cooled gas stream is supplied to a first distillation column at a mid-column feed position;

(3) said expanded cooled gas stream is fractionated in said first distillation column at said first intermediate pressure to form a first overhead vapor stream comprising nitrogen and no more than 0.001 mole % carbon dioxide and a first hydrocarbon liquid stream containing a major portion of said carbon dioxide;

(4) said first hydrocarbon liquid stream is pumped and heated to form a heated first hydrocarbon liquid stream, thereby to supply at least a portion of the cooling of step (1);

(5) said heated first hydrocarbon liquid stream is supplied to a fractionation system to fractionate said heated first hydrocarbon liquid stream to form said relatively less volatile fraction containing a portion of said heavier hydrocarbon components and a first hydrocarbon vapor stream containing methane and the remaining portion of said heavier hydrocarbon components;

(6) said first overhead vapor stream is cooled sufficiently to form a partially condensed stream while measuring a temperature of said partially condensed stream and comparing the temperature to a setpoint;

(7) said partially condensed stream is separated thereby to provide a first vapor stream and a first liquid stream, whereupon said first liquid stream is supplied to said first distillation column at a top feed position;

(8) said first vapor stream is cooled and then expanded to a lower pressure to form an expanded cooled stream;

(9) said expanded cooled stream is supplied to a distillation system to distill said expanded cooled stream to form a heated vapor stream containing a major portion of said nitrogen and a heated second hydrocarbon liquid stream;

(10) said heated vapor stream is further heated to form said purge stream, thereby to supply at least a portion of the cooling of steps (1), (6), and (8);

(11) said heated second hydrocarbon liquid stream is further heated to vaporize said second hydrocarbon liquid stream to form a second hydrocarbon vapor stream, thereby to supply at least a portion of the cooling of steps (1), (6), and (8);

(12) said second hydrocarbon vapor stream is compressed to a first higher pressure and cooled to form a cooled compressed vapor stream;

(13) said cooled compressed vapor stream and said first hydrocarbon vapor stream are combined to form said volatile residue gas fraction;

(14) a refrigerant stream is cooled to form a cooled refrigerant stream, thereby to supply at least a portion of the heating of steps (4), (10), and (11);

(15) said cooled refrigerant stream is expanded to a second intermediate pressure to form an expanded cooled refrigerant stream, with the second intermediate pressure adjusted based on the comparison of the temperature of the partially condensed stream to the setpoint;

(16) said expanded cooled refrigerant stream is heated to form a heated refrigerant stream, thereby to supply at least a portion of the cooling of steps (1), (6), (8), and (14);

(17) said heated refrigerant stream is compressed to a second higher pressure and cooled to form said refrigerant stream; and

(18) the quantities and temperatures of said feed streams to said first distillation column are effective to maintain the overhead temperature of said first distillation column at a temperature whereby the major portion of said carbon dioxide is recovered in said first hydrocarbon liquid stream.

2. The process according to claim 1 wherein (a) said expanded cooled stream is separated thereby to provide a second vapor stream and a second liquid stream;

(b) said second vapor stream is cooled and then expanded to a still lower pressure to form an expanded cooled vapor stream, whereupon said expanded cooled vapor stream is supplied to a second distillation column at a top feed position;

(c) said second liquid stream is cooled and then expanded to said still lower pressure to form an expanded cooled liquid stream, whereupon said expanded cooled liquid stream is supplied to said second distillation column at a mid-column feed position;

(d) said expanded cooled vapor stream and said expanded cooled liquid stream are fractionated in said second distillation column at said still lower pressure to form a second overhead vapor stream containing a major portion of said nitrogen and a second hydrocarbon liquid stream;

(e) said second overhead vapor stream is heated to form said heated vapor stream, thereby to supply at least a portion of the cooling of steps (b) and (c);

(f) said second hydrocarbon liquid stream is pumped and heated to form said heated second hydrocarbon liquid stream, thereby to supply at least a portion of the cooling of steps (b) and (c); and (g) the quantities and temperatures of said feed streams to said second distillation column are effective to maintain the overhead temperature of said second distillation column at a temperature whereby the major portion of said methane is recovered in said second hydrocarbon liquid stream.

3. The process according to claim 1 wherein (a) said expanded cooled stream is separated thereby to provide a second vapor stream and a second liquid stream;

(b) said second vapor stream is cooled and then expanded to a still lower pressure to form an expanded cooled vapor stream, whereupon said expanded cooled vapor stream is supplied to a second distillation column at a mid-column feed position;

(c) said second liquid stream is cooled and then expanded to said still lower pressure to form an expanded cooled liquid stream, whereupon said expanded cooled liquid stream is supplied to said second distillation column at a lower mid-column feed position below that of said mid-column feed position;

(d) said expanded cooled vapor stream and said expanded cooled liquid stream are fractionated in said second distillation column at said still lower pressure to form a second overhead vapor stream containing a major portion of said nitrogen and a second hydrocarbon liquid stream;

(e) said second hydrocarbon liquid stream is pumped and heated to form said heated second hydrocarbon liquid stream, thereby to supply at least a portion of the cooling of steps (b) and (c);

(f) said second overhead vapor stream is heated to form said heated vapor stream, thereby to supply at least a portion of the cooling of steps (b) and (c);

(g) said heated vapor stream is further heated to form a further heated vapor stream, thereby to supply at least a portion of the cooling of steps (6) and (8);

(h) said further heated vapor stream is divided into a first portion and a second portion;

(i) said first portion is heated to form said purge stream, thereby to supply at least a portion of the cooling of step (1);

(j) said second portion is compressed to a third intermediate pressure to form a compressed second portion;

(k) said compressed second portion is cooled and condensed to form a condensed second portion; thereby to supply at least a portion of the heating of steps (4), (10), (11), (e), and (f);

(l) said condensed second portion is expanded to said still lower pressure to form an expanded second portion, whereupon said expanded second portion is supplied to said second distillation column at a top feed position; and (m) the quantities and temperatures of said feed streams to said second distillation column are effective to maintain the overhead temperature of said second distillation column at a temperature whereby the major portion of said methane is recovered in said second hydrocarbon liquid stream.

4. The process according to claim 1 wherein (a) said expanded cooled stream is separated thereby to provide a second vapor stream and a second liquid stream;

(b) said second vapor stream is cooled and then expanded to a still lower pressure to form an expanded cooled vapor stream, whereupon said expanded cooled vapor stream is supplied to a second distillation column at a mid-column feed position;

(c) said second liquid stream is cooled and then expanded to said still lower pressure to form an expanded cooled liquid stream, whereupon said expanded cooled liquid stream is supplied to said second distillation column at a lower mid-column feed position below that of said mid-column feed position;

(d) said expanded cooled vapor stream and said expanded cooled liquid stream are fractionated in said second distillation column at said still lower pressure to form a second overhead vapor stream containing a major portion of said nitrogen and a second hydrocarbon liquid stream;

(e) said second hydrocarbon liquid stream is pumped and heated to form said heated second hydrocarbon liquid stream, thereby to supply at least a portion of the cooling of steps (b) and (c);

(f) said second overhead vapor stream is divided into a first portion and a second portion;

(g) said first portion is heated to form said heated vapor stream, thereby to supply at least a portion of the cooling of steps (b) and (c);

(h) said second portion is compressed to a third intermediate pressure to form a compressed second portion;

(i) said compressed second portion is cooled and condensed to form a condensed second portion; thereby to supply at least a portion of the heating of steps (e) and (g);

(j) said condensed second portion is expanded to said still lower pressure to form an expanded second portion, whereupon said expanded second portion is supplied to said second distillation column at a top feed position; and (k) the quantities and temperatures of said feed streams to said second distillation column are effective to maintain the overhead temperature of said second distillation column at a temperature whereby the major portion of said methane is recovered in said second hydrocarbon liquid stream.

5. The process according to claim 1 wherein (a) said expanded cooled stream is supplied at a bottom feed position to an absorber column that produces a second vapor stream and a second liquid stream;

(b) said second vapor stream is cooled and condensed to form a condensed stream;

(c) said condensed stream is divided into a first reflux stream and a second reflux stream, whereupon said first reflux stream is supplied to said absorber column at a top feed position;

(d) said second reflux stream is cooled and then expanded to a still lower pressure to form an expanded cooled second reflux stream, whereupon said expanded cooled second reflux stream is supplied to a second distillation column at a top feed position;

(e) said second liquid stream is cooled and then expanded to said still lower pressure to form an expanded cooled liquid stream, whereupon said expanded cooled liquid stream is supplied to said second distillation column at a mid-column feed position;

(f) said expanded cooled second reflux stream and said expanded cooled liquid stream are fractionated in said second distillation column at said still lower pressure to form a second overhead vapor stream containing a major portion of said nitrogen and a second hydrocarbon liquid stream;

(g) said second overhead vapor stream is heated to form said heated vapor stream, thereby to supply at least a portion of the cooling of steps (b), (d), and (e);

(h) said second hydrocarbon liquid stream is pumped and heated to form said heated second hydrocarbon liquid stream, thereby to supply at least a portion of the cooling of steps (b), (d), and (e); and (i) the quantities and temperatures of said feed streams to said second distillation column are effective to maintain the overhead temperature of said second distillation column at a temperature whereby the major portion of said methane is recovered in said second hydrocarbon liquid stream.

6. The process according to claim 1 wherein (a) said expanded cooled stream is separated thereby to provide a second vapor stream and a second liquid stream;

(b) said second vapor stream is cooled to form a cooled stream, with said cooling sufficient to partially condense said cooled stream;

(c) said cooled stream is separated to provide a third vapor stream and a third liquid stream;

(d) said third vapor stream is cooled and condensed, then expanded to a still lower pressure to form an expanded condensed stream, whereupon said expanded condensed stream is supplied to a second distillation column at a top feed position;

(e) said third liquid stream is expanded to said still lower pressure to form an expanded liquid stream, whereupon said expanded liquid stream is supplied to said second distillation column at a mid-column feed position;

(f) said second liquid stream is cooled and then expanded to said still lower pressure to form an expanded cooled liquid stream, whereupon said expanded cooled liquid stream is supplied to said second distillation column at a lower mid-column feed position below that of said mid-column feed position;

(g) said expanded cooled vapor stream, said expanded liquid stream, and said expanded cooled liquid stream are fractionated in said second distillation column at said still lower pressure to form a second overhead vapor stream containing a major portion of said nitrogen and a second hydrocarbon liquid stream;

(h) said second hydrocarbon liquid stream is pumped and heated to form said heated second hydrocarbon liquid stream, thereby to supply at least a portion of the cooling of steps (b), (d), and (f);

(i) said second overhead vapor stream is heated to form said heated vapor stream, thereby to supply at least a portion of the cooling of steps (b), (d), and (f); and (j) the quantities and temperatures of said feed streams to said second distillation column are effective to maintain the overhead temperature of said second distillation column at a temperature whereby the major portion of said methane is recovered in said second hydrocarbon liquid stream.

7. The process according to claim 1 wherein (a) said gas stream is expanded to a third intermediate pressure to form an expanded gas stream;

(b) said expanded gas stream is separated to produce a light vapor stream and a heavy liquid stream;

(c) said heavy liquid stream is combined with said cooled compressed vapor stream and said first hydrocarbon vapor stream to form said volatile residue gas fraction; and (d) said light vapor stream is compressed to a third higher pressure and cooled under pressure to form said cooled gas stream.

8. The process according to claim 3 wherein (a) said gas stream is expanded to a fourth intermediate pressure to form an expanded gas stream;

(b) said expanded gas stream is separated to produce a light vapor stream and a heavy liquid stream;

(c) said heavy liquid stream is combined with said cooled compressed vapor stream and said first hydrocarbon vapor stream to form said volatile residue gas fraction; and (d) said light vapor stream is compressed to a third higher pressure and cooled under pressure to form said cooled gas stream.

9. The process according to claim 1 wherein (a) said gas stream is cooled under pressure to form a partially cooled gas stream;

(b) said partially cooled gas stream is separated to produce a light vapor stream and a heavy liquid stream;

(c) said light vapor stream is further cooled under pressure to form said cooled gas stream;

(d) said heavy liquid stream is combined with said pumped first hydrocarbon liquid stream to form a combined liquid stream;

(e) said combined liquid stream is heated to form a heated combined liquid stream, thereby to supply at least a portion of the cooling of step (c); and (f) said heated combined liquid stream is supplied to said fractionation system.

10. The process according to claim 1 wherein (a) said cooled compressed vapor stream is combined with said heated refrigerant stream to form a combined stream;

(b) said combined stream is compressed to said second higher pressure and cooled to form a cooled compressed combined stream;

(c) said cooled compressed combined stream is divided into a third hydrocarbon vapor stream and said refrigerant stream; and (d) said third hydrocarbon vapor stream and said first hydrocarbon vapor stream are combined to form said volatile residue gas fraction.

11. An apparatus for the separation of a gas stream containing methane, heavier hydrocarbon components, and significant quantities of nitrogen and carbon dioxide into (i) a purge stream containing a major portion of said nitrogen, (ii) a volatile residue gas fraction containing a major portion of said methane, and (iii) a relatively less volatile fraction containing a portion of said heavier hydrocarbon components comprising (1) first heat exchange means connected to receive said gas stream and cool said gas stream under pressure to form a cooled gas stream;

(2) first expansion means connected to said first heat exchange means to receive said cooled gas stream and expand said cooled gas stream to a first intermediate pressure to form an expanded cooled gas stream;

(3) a first distillation column connected to said first expansion means to receive said expanded cooled gas stream at a mid-column feed position;

(4) said first distillation column adapted to fractionate said expanded cooled gas stream at said first intermediate pressure to form a first overhead vapor stream comprising nitrogen and no more than 0.001 mole % carbon dioxide and a first hydrocarbon liquid stream containing a major portion of said carbon dioxide;

(5) first pumping means connected to said first distillation column to received said first hydrocarbon liquid stream and pump said first hydrocarbon liquid stream to form a pumped first hydrocarbon liquid stream;

(6) said first heat exchange means further connected to said first pumping means to receive said pumped first hydrocarbon liquid stream and heat said pumped first hydrocarbon liquid stream to form a heated first hydrocarbon liquid stream, thereby to supply at least a portion of the cooling of step (1);

(7) fractionation means connected to said first heat exchange means to receive said heated first hydrocarbon liquid stream and fractionate said heated first hydrocarbon liquid stream to form said relatively less volatile fraction containing a portion of said heavier hydrocarbon components and a first hydrocarbon vapor stream containing methane and the remaining portion of said heavier hydrocarbon components;

(8) second heat exchange means connected to said first distillation column to receive said first overhead vapor stream and cool said first overhead vapor stream sufficiently to form a partially condensed stream, (9) a control device includes a sensor for measuring a temperature of said partially condensed stream and said device is configured to compare said temperature to a setpoint;

(10) first separating means connected to said second heat exchange means to receive said partially condensed stream and separate said partially condensed stream into a first vapor stream and a first liquid stream, said first separating means being further connected to said first distillation column to supply said first liquid stream to said first distillation column at a top feed position;

(11) said second heat exchange means further connected to said first separating means to receive said first vapor stream and cool said first vapor stream to form a cooled first vapor stream;

(12) second expansion means connected to said second heat exchange means to receive said cooled first vapor stream and expand said cooled first vapor stream to a lower pressure to form an expanded cooled stream;

(13) distillation means connected to said second expansion means to receive said expanded cooled stream to distill said expanded cooled stream to form a heated vapor stream containing a major portion of said nitrogen and a heated second hydrocarbon liquid stream;

(14) said second heat exchange means further connected to said distillation means and said first exchange means further connected to said second heat exchange means to receive said heated vapor stream and further heat said heated vapor stream to form said purge stream, thereby to supply at least a portion of the cooling of steps (1), (8), and (11);

(15) said second heat exchange means further connected to said distillation means and said first exchange means further connected to said second heat exchange means to receive said heated second hydrocarbon liquid stream and further heat and vaporize said heated second hydrocarbon liquid stream to form a second hydrocarbon vapor stream, thereby to supply at least a portion of the cooling of steps (1), (8), and (11);

(16) first compressing and cooling means connected to said first heat exchange means to receive said second hydrocarbon vapor stream and compress to a first higher pressure and cool said second hydrocarbon vapor stream to form a cooled compressed vapor stream;

(17) combining means connected to said first compressing and cooling means and to said fractionation means to receive said cooled compressed vapor stream and said first hydrocarbon vapor stream and combine said cooled compressed vapor stream and said first hydrocarbon vapor stream to form said volatile residue gas fraction;

(18) said first heat exchange means further connected to receive a refrigerant stream and further connected to said second heat exchange means to cool said refrigerant stream to form a cooled refrigerant stream, thereby to supply at least a portion of the heating of steps (6), (14), and (15);

(19) third expansion means connected to said second heat exchange means to receive said cooled refrigerant stream and expand said cooled refrigerant stream to a second intermediate pressure to form an expanded cooled refrigerant stream wherein said control device adjusts said third expansion means to control said second intermediate pressure based on the comparison of the temperature of the partially condensed stream to the setpoint;

(20) said second heat exchange means further connected to said third expansion means and said first heat exchange means further connected to said second heat exchange means to receive said expanded cooled refrigerant stream and heat said expanded cooled refrigerant stream to form a heated refrigerant stream, thereby to supply at least a portion of the cooling of steps (1), (8), (11), and (18);

(21) second compressing and cooling means connected to said first heat exchange means to receive said heated refrigerant stream and compress to a second higher pressure and cool said heated refrigerant stream to form said refrigerant stream, said second compressing and cooling means being further connected to said first heat exchange means to supply said refrigerant stream thereto; and

(22) first control means adapted to regulate the quantities and temperatures of said expanded cooled gas stream and said first liquid stream to said first distillation column to maintain the overhead temperature of said first distillation column at a temperature whereby the major portion of said carbon dioxide is recovered in said first hydrocarbon liquid stream.

12. The apparatus according to claim 11 wherein said distillation means is comprised of (a) second separating means connected to said second expansion means to receive said expanded cooled stream and separate said expanded cooled stream into a second vapor stream and a second liquid stream;

(b) third heat exchange means connected to said second separating means to receive said second vapor stream and cool said second vapor stream to form a cooled vapor stream;

(c) fourth expansion means connected to said third heat exchange means to receive said cooled vapor stream and expand said cooled vapor stream to a still lower pressure to form an expanded cooled vapor stream;

(d) second distillation column connected to said fourth expansion means to receive said expanded cooled vapor stream at a top feed position;

(e) said third heat exchange means further connected to said second separating means to receive said second liquid stream and cool said second liquid stream to form a cooled liquid stream;

(f) fifth expansion means connected to said third heat exchange means to receive said cooled liquid stream and expand said cooled liquid stream to said still lower pressure to form an expanded cooled liquid stream, said fifth expansion means being further connected to said second distillation column to supply said expanded cooled liquid stream to said second distillation column at a mid-column feed position;

(g) said second distillation column adapted to fractionate said expanded cooled vapor stream and said expanded cooled liquid stream at said still lower pressure to form a second overhead vapor stream containing a major portion of said nitrogen and a second hydrocarbon liquid stream;

(h) said third heat exchange means further connected to said second distillation column to receive said second overhead vapor stream and heat said second overhead vapor stream to form said heated vapor stream, thereby to supply at least a portion of the cooling of steps (b) and (e);

(i) second pumping means connected to said second distillation column to received said second hydrocarbon liquid stream and pump said second hydrocarbon liquid stream to form a pumped second hydrocarbon liquid stream;

(j) said third heat exchange means further connected to said second pumping means to receive said pumped second hydrocarbon liquid stream and heat said pumped second hydrocarbon liquid stream to form said heated second hydrocarbon vapor stream, thereby to supply at least a portion of the cooling of steps (b) and (e); and (k) second control means adapted to regulate the quantities and temperatures of said expanded cooled vapor stream and said expanded cooled liquid stream to said second distillation column to maintain the overhead temperature of said second distillation column at a temperature whereby the major portion of said methane is recovered in said second hydrocarbon liquid stream.

13. The apparatus according to claim 11 wherein said distillation means is comprised of (a) second separating means connected to said second expansion means to receive said expanded cooled stream and separate said expanded cooled stream into a second vapor stream and a second liquid stream;

(b) third heat exchange means connected to said second separating means to receive said second vapor stream and cool said second vapor stream to form a cooled vapor stream;

(c) fourth expansion means connected to said third heat exchange means to receive said cooled vapor stream and expand said cooled vapor stream to a still lower pressure to form an expanded cooled vapor stream;

(d) second distillation column connected to said fourth expansion means to receive said expanded cooled vapor stream at a mid-column feed position;

(e) said third heat exchange means further connected to said second separating means to receive said second liquid stream and cool said second liquid stream to form a cooled liquid stream;

(f) fifth expansion means connected to said third heat exchange means to receive said cooled liquid stream and expand said cooled liquid stream to said still lower pressure to form an expanded cooled liquid stream, said fifth expansion means being further connected to said second distillation column to supply said expanded cooled liquid stream to said second distillation column at a lower mid-column feed position below said mid-column feed position;

(g) said second distillation column adapted to fractionate said expanded cooled vapor stream and said expanded cooled liquid stream at said still lower pressure to form a second overhead vapor stream containing a major portion of said nitrogen and a second hydrocarbon liquid stream;

(h) said third heat exchange means further connected to said second distillation column to receive said second overhead vapor stream and heat said second overhead vapor stream to form said heated vapor stream, thereby to supply at least a portion of the cooling of steps (b) and (e);

(i) second pumping means connected to said second distillation column to received said second hydrocarbon liquid stream and pump said second hydrocarbon liquid stream to form a pumped second hydrocarbon liquid stream; and (j) said third heat exchange means further connected to said second pumping means to receive said pumped second hydrocarbon liquid stream and heat said pumped second hydrocarbon liquid stream to form said heated second hydrocarbon vapor stream, thereby to supply at least a portion of the cooling of steps (b) and (e);

and the adaptation of said apparatus is such that (k) said second heat exchange means is adapted to further heat said heated vapor stream to form a further heated vapor stream, thereby to supply at least a portion of the cooling of steps (8) and (10);

(l) a dividing means is connected to said second heat exchange means to receive said further heated vapor stream and divide said further heated vapor stream into a first portion and a second portion;

(m) said first heat exchange means is adapted to receive said first portion and heat said first portion to form said purge stream, thereby to supply at least a portion of the cooling of step (l);

(n) a third compressing and cooling means is connected to said dividing means to receive said second portion and compress second portion to a third intermediate pressure to form a compressed second portion; and (o) said first heat exchange means is further connected to said third compressing and cooling means to receive said compressed second portion and further connected to cool said compressed second portion to form a cooled second portion, thereby to supply at least a portion of the heating of steps (13) and (14); and and said distillation means is further comprised of (p) said third heat exchange means further connected to said second heat exchange means to receive said cooled second portion and further cool and condense said cooled second portion to form a condensed second portion, thereby to provide at least a portion of the heating of steps (h) and (j); and (q) sixth expansion means connected to said third heat exchange means to receive said condensed second portion and expand said condensed second portion to said still lower pressure to form an expanded second portion, said sixth expansion means being further connected to said second distillation column to supply said expanded second portion to said second distillation column at a top feed position; and (r) second control means adapted to regulate the quantities and temperatures of said expanded second portion, said expanded cooled vapor stream, and said expanded cooled liquid stream to said second distillation column to maintain the overhead temperature of said second distillation column at a temperature whereby the major portion of said methane is recovered in said second hydrocarbon liquid stream.

14. The apparatus according to claim 11 wherein said distillation means is comprised of (a) second separating means connected to said second expansion means to receive said expanded cooled stream and separate said expanded cooled stream into a second vapor stream and a second liquid stream;

(b) third heat exchange means connected to said second separating means to receive said second vapor stream and cool said second vapor stream to form a cooled vapor stream;

(c) fourth expansion means connected to said third heat exchange means to receive said cooled vapor stream and expand said cooled vapor stream to a still lower pressure to form an expanded cooled vapor stream;

(d) second distillation column connected to said fourth expansion means to receive said expanded cooled vapor stream at a mid-column feed position;

(e) said third heat exchange means further connected to said second separating means to receive said second liquid stream and cool said second liquid stream to form a cooled liquid stream;

(f) fifth expansion means connected to said third heat exchange means to receive said cooled liquid stream and expand said cooled liquid stream to said still lower pressure to form an expanded cooled liquid stream, said fifth expansion means being further connected to said second distillation column to supply said expanded cooled liquid stream to said second distillation column at a lower mid-column feed position below said mid-column feed position;

(g) said second distillation column adapted to fractionate said expanded cooled vapor stream and said expanded cooled liquid stream at said still lower pressure to form a second overhead vapor stream containing a major portion of said nitrogen and a second hydrocarbon liquid stream;

(h) second pumping means connected to said second distillation column to received said second hydrocarbon liquid stream and pump said second hydrocarbon liquid stream to form a pumped second hydrocarbon liquid stream;

(i) said third heat exchange means further connected to said second pumping means to receive said pumped second hydrocarbon liquid stream and heat said pumped second hydrocarbon liquid stream to form said heated second hydrocarbon vapor stream, thereby to supply at least a portion of the cooling of steps (b) and (e);

(j) dividing means connected to said second distillation column to receive said second overhead vapor stream and divide said second overhead vapor stream into a first portion and a second portion;

(k) said third heat exchange means further connected to said dividing means to receive said first portion and heat said first portion to form said heated vapor stream, thereby to supply at least a portion of the cooling of steps (b) and (e);

(l) compressing means connected to said dividing means to receive said second portion and compress said second portion to a third intermediate pressure to form a compressed second portion;

(m) said third heat exchange means further connected to said compressing means to receive said compressed second portion and cool and condense said second portion to form a condensed second portion;

(n) sixth expansion means connected to said third heat exchange means to receive said condensed second portion and expand said condensed second portion to said still lower pressure to form an expanded second portion, said sixth expansion means being further connected to said second distillation column to supply said expanded second portion to said second distillation column at a top feed position; and (o) second control means adapted to regulate the quantities and temperatures of said expanded second portion, said expanded cooled vapor stream, and said expanded cooled liquid stream to said second distillation column to maintain the overhead temperature of said second distillation column at a temperature whereby the major portion of said methane is recovered in said second hydrocarbon liquid stream.

15. The apparatus according to claim 11 wherein said distillation means is comprised of (a) absorption column connected to said second expansion means to receive said expanded cooled stream at a bottom feed position and produce a second vapor stream and a second liquid stream;

(b) third heat exchange means connected to said absorption column to receive said second vapor stream and cool and condense said second vapor stream to form a condensed stream;

(c) dividing means connected to said third heat exchange means to receive said condensed stream and divide said condensed stream into a first reflux stream and a second reflux stream;

(d) said absorption column further connected to said dividing means to receive said first reflux stream at a top feed position;

(e) third heat exchange means further connected to said dividing means to receive said second reflux stream and cool said second reflux stream to form a cooled second reflux stream;

(f) fourth expansion means connected to said third heat exchange means to receive said cooled second reflux stream and expand said cooled second reflux stream to a still lower pressure to form an expanded cooled second reflux stream;

(g) second distillation column connected to said fourth expansion means to receive said expanded cooled second reflux stream at a top feed position;

(h) said third heat exchange means further connected to said absorption column to receive said second liquid stream and cool said second liquid stream to form a cooled liquid stream;

(i) fifth expansion means connected to said third heat exchange means to receive said cooled liquid stream and expand said cooled liquid stream to said still lower pressure to form an expanded cooled liquid stream, said fifth expansion means being further connected to said second distillation column to supply said expanded cooled liquid stream to said second distillation column at a mid-column feed position;

(j) said second distillation column adapted to fractionate said expanded cooled second reflux stream and said expanded cooled liquid stream at said still lower pressure to form a second overhead vapor stream containing a major portion of said nitrogen and a second hydrocarbon liquid stream;

(k) said third heat exchange means further connected to said second distillation column to receive said second overhead vapor stream and heat said second overhead vapor stream to form said heated vapor stream, thereby to supply at least a portion of the cooling of steps (b), (e), and (h);

(l) second pumping means connected to said second distillation column to received said second hydrocarbon liquid stream and pump said second hydrocarbon liquid stream to form a pumped second hydrocarbon liquid stream;

(m) said third heat exchange means further connected to said second pumping means to receive said pumped second hydrocarbon liquid stream and heat said pumped second hydrocarbon liquid stream to form said heated second hydrocarbon vapor stream, thereby to supply at least a portion of the cooling of steps (b), (e), and (h); and (n) second control means adapted to regulate the quantities and temperatures of said expanded cooled second reflux stream and said expanded cooled liquid stream to said second distillation column to maintain the overhead temperature of said second distillation column at a temperature whereby the major portion of said methane is recovered in said second hydrocarbon liquid stream.

16. The apparatus according to claim 11 wherein said distillation means is comprised of (a) second separating means connected to said second expansion means to receive said expanded cooled stream and separate said expanded cooled stream into a second vapor stream and a second liquid stream;

(b) third heat exchange means connected to said second separating means to receive said second vapor stream and cool and partially condense said second vapor stream to form a cooled stream;

(c) third separating means connected to said third heat exchange means to receive said cooled stream and separate said cooled stream into a third vapor stream and a third liquid stream;

(d) fourth expansion means connected to said third separating means to receive said third liquid stream and expand said third liquid stream to a still lower pressure to form an expanded liquid stream;

(e) second distillation column connected to said fourth expansion means to receive said expanded liquid stream at a mid-column feed position;

(f) said third heat exchange means further connected to said second separating means to receive said second liquid stream and cool said second liquid stream to form a cooled liquid stream;

(g) fifth expansion means connected to said third heat exchange means to receive said cooled liquid stream and expand said cooled liquid stream to said still lower pressure to form an expanded cooled liquid stream, said fifth expansion means being further connected to said second distillation column to supply said expanded cooled liquid stream to said second distillation column at a lower mid-column feed position below said mid-column feed position;

(h) third heat exchange means further connected to said third separating means to receive said third vapor stream and cool and condense said third vapor stream to form a condensed stream;

(i) sixth expansion means connected to said third heat exchange means to receive said condensed stream and expand said condensed stream to said still lower pressure to form an expanded condensed stream, said sixth expansion means being further connected to said second distillation column to supply said expanded condensed stream to said second distillation column at a top feed position;

(j) said second distillation column adapted to fractionate said expanded condensed stream, said expanded liquid stream, and said expanded cooled liquid stream at said still lower pressure to form a second overhead vapor stream containing a major portion of said nitrogen and a second hydrocarbon liquid stream;

(k) second pumping means connected to said second distillation column to received said second hydrocarbon liquid stream and pump said second hydrocarbon liquid stream to form a pumped second hydrocarbon liquid stream;

(l) said third heat exchange means further connected to said second pumping means to receive said pumped second hydrocarbon liquid stream and heat said pumped second hydrocarbon liquid stream to form said heated second hydrocarbon vapor stream, thereby to supply at least a portion of the cooling of steps (b), (f), and (h);

(m) said third heat exchange means further connected to said second distillation column to receive said second overhead vapor stream and heat said second overhead vapor stream to form said heated vapor stream, thereby to supply at least a portion of the cooling of steps (b), (f), and (h); and (n) second control means adapted to regulate the quantities and temperatures of said expanded condensed stream, said expanded liquid stream, and said expanded cooled liquid stream to said second distillation column to maintain the overhead temperature of said second distillation column at a temperature whereby the major portion of said methane is recovered in said second hydrocarbon liquid stream.

17. The apparatus according to claim 11 wherein (a) an additional expansion means is connected to receive said gas stream and expand said gas stream to a third intermediate pressure to form an expanded gas stream;

(b) an additional separation means is connected to said additional expansion means to receive said expanded gas stream and separate said expanded gas stream into a light vapor stream and a heavy liquid stream;

(c) said combining means is adapted to connect to said additional separation means to receive said heavy liquid stream and combine said heavy liquid stream with said cooled compressed vapor stream and said first hydrocarbon vapor stream to form volatile residue gas fraction;

(d) a vapor compressing means is connected to aid additional separation means to receive said light vapor stream and compress said light vapor stream to a third higher pressure to form a compressed vapor stream; and (e) said first heat exchange means is adapted to connect to said vapor compressing means to receive said compressed vapor stream and cool said compressed vapor stream to form said cooled gas stream.

18. The apparatus according to claim 13 wherein (a) an additional expansion means is connected to receive said gas stream and expand said gas stream to a fourth intermediate pressure to form an expanded gas stream;

(b) an additional separation means is connected to said additional expansion means to receive said expanded gas stream and separate said expanded gas stream into a light vapor stream and a heavy liquid stream;

(c) said combining means is adapted to connect to said additional separation means to receive said heavy liquid stream and combine said heavy liquid stream with said cooled compressed vapor stream and said first hydrocarbon vapor stream to form volatile residue gas fraction;

(d) a vapor compressing means is connected to aid additional separation means to receive said light vapor stream and compress said light vapor stream to a third higher pressure to form a compressed vapor stream; and (e) said first heat exchange means is adapted to connect to said vapor compressing means to receive said compressed vapor stream and cool said compressed vapor stream to form said cooled gas stream.

19. The apparatus according to claim 11, wherein (a) said first heat exchange means is adapted to cool said gas stream sufficiently to partially condense said gas stream to form a partially cooled gas stream;

(b) an additional separation means is connected to said first heat exchange means to receive said partially cooled gas stream and separate said partially cooled gas stream into a light vapor stream and a heavy liquid stream;

(c) said first heat exchange means is further adapted to be connected to said additional separation means to receive said light vapor stream and cool said light vapor stream to form said cooled gas stream;

(d) an additional combining means is connected to said additional separation means and to said first pumping means to receive said heavy liquid stream and said pumped first hydrocarbon liquid stream and combine said heavy liquid stream and said pumped first hydrocarbon liquid stream to form a combined liquid stream;

(e) said first heat exchange means is further adapted to be connected to said additional combining means to receive said combined liquid stream and heat said combined liquid stream to form a heated combined liquid stream, thereby to supply at least a portion of the cooling of step (1); and (f) said fractionation means is adapted to be connected to said first heat exchange means to receive said heated combined liquid stream and fractionate said heated combined liquid stream to form said relatively less volatile fraction containing a portion of said heavier hydrocarbon components and said first hydrocarbon vapor stream containing methane and the remaining portion of said heavier hydrocarbon components.

20. The apparatus according to claim 14 wherein (a) a gas combining means is connected to said first compressing and cooling means and to said first heat exchange means to receive said cooled compressed vapor stream and said heated refrigerant stream and combine said cooled compressed vapor stream and said heated refrigerant stream to form a combined gas stream;

(b) said second compressing and cooling means is adapted to be connected to said gas combining means to receive said combined gas stream and compress to said second higher pressure and cool said combined gas stream to form a cooled compressed combined gas stream;

(c) a gas dividing means is connected to said second compressing and cooling means to receive said cooled compressed combined gas stream and divide said cooled compressed combined gas stream into a third hydrocarbon vapor stream and said refrigerant stream, said gas dividing means being further connected to said first heat exchange means to supply said refrigerant stream thereto; and (d) said combining means is adapted to be connected to said gas dividing means to receive said third hydrocarbon vapor stream and combine said third hydrocarbon vapor stream and said first hydrocarbon vapor stream to form said volatile residue gas fraction.

* * * * *